US008729785B2

(12) United States Patent
Shimamura et al.

(10) Patent No.: US 8,729,785 B2
(45) Date of Patent: May 20, 2014

(54) SPARK PLUG

(71) Applicant: NGK Spark Plug Co., Ltd., Nagoya (JP)

(72) Inventors: Takuya Shimamura, Nagoya (JP); Jiro Kyuno, Kiyosu (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/685,008

(22) Filed: Nov. 26, 2012

(65) Prior Publication Data

US 2013/0134857 A1 May 30, 2013

(30) Foreign Application Priority Data

Nov. 25, 2011 (JP) ..... 2011-257033

(51) Int. Cl.
*H01T 13/00* (2006.01)

(52) U.S. Cl.
USPC ..... 313/144; 313/118; 313/143

(58) Field of Classification Search
USPC ..... 313/118–145; 445/7; 219/121.6, 219/121.64; 123/32, 41, 143 R, 146.5 R, 123/169 P, 260, 280, 169 R, 169 EL, 310
See application file for complete search history.

(56) References Cited

U.S. PATENT DOCUMENTS

| | | | |
|---|---|---|---|
| 6,310,430 | B1 | 10/2001 | Moriya |
| 6,566,793 | B2 | 5/2003 | Honda et al. |
| 7,893,604 | B2 | 2/2011 | Takeuchi et al. |
| 2001/0002096 | A1 | 5/2001 | Honda et al. |

FOREIGN PATENT DOCUMENTS

| | | | |
|---|---|---|---|
| JP | 11-273827 | A | 10/1999 |
| JP | 2000-243535 | A | 9/2000 |
| JP | 2001-155839 | A | 6/2001 |
| JP | 2008-108478 | A | 5/2008 |

OTHER PUBLICATIONS

Office Action mailed Oct. 15, 2013 for the corresponding Japanese Patent Application No. 2011-257033.

*Primary Examiner* — Donald Raleigh
(74) *Attorney, Agent, or Firm* — Leason Ellis LLP.

(57) ABSTRACT

A spark plug comprises an insulator and a metal shell. The insulator includes a nose length portion at the forward end, and a tapered portion, extending from the rear end of the nose length portion toward the rear end of the insulator, increased in diameter toward the rear end. The metal shell includes a shoulder portion, protruding inward and having a retaining surface by which the tapered portion is retained, and a male thread portion on the outer peripheral side of the shoulder portion, and the thread diameter of the male thread portion is set to M12 or less. When the insulator's cross-sectional area, perpendicular to an axis, passing through the boundary between the nose length section and tapered portion is B ($mm^2$), and the metal shell's cross-sectional area, perpendicular to the axis, passing through the tip of the retaining surface is C ($mm^2$), $2.80 \leq C/B \leq 3.50$ is satisfied.

5 Claims, 7 Drawing Sheets

SPARK PLUG

CROSS-REFERENCE TO RELATED PATENT APPLICATIONS

This application claims the benefit of Japanese Patent Application No. 2011-257033, filed Nov. 25, 2012, which is incorporated by reference herein.

FIELD OF THE INVENTION

The present invention relates to a spark plug used in an internal combustion engine, or the like.

BACKGROUND OF THE INVENTION

A spark plug, by being mounted in a combustion device such as an internal combustion engine (an engine), is used for igniting a mixture in a combustion chamber. Also, the spark plug includes an insulator having an axial hole, a center electrode inserted in a forward end portion of the axial hole, a metal shell provided on the outer periphery of the insulator, and a ground electrode, joined to a forward end portion of the metal shell, forming a spark discharge gap between itself and the center electrode (for example, refer to JP-A-2008-108478).

In addition, the insulator includes an insulator nose length portion, formed in a forward end portion of the insulator, exposed inside the combustion chamber, and a tapered portion, extending from the rear end of the insulator nose length portion toward a rear end side, the outside diameter of which is increased toward the rear end side. Further, the insulator is retained on the metal shell by the tapered portion being directly or indirectly retained by a shoulder portion formed on the inner periphery of the metal shell so as to protrude therefrom.

Furthermore, in recent years, a reduction in size (diameter) of the spark plug has been demanded, along with which a reduction in diameter of the insulator has been required. The wall thickness of this kind of insulator reduced in diameter is made comparatively small.

Also, a highly efficient engine which has achieved downsizing, higher supercharging and compression, or the like, is proposed in order to respond to the tighter environmental regulations. In this kind of engine, when it operates, a very large vibration is applied to a spark plug, and the spark plug is heated to a higher temperature. In addition, with this kind of highly efficient engine, an insulator crack in a boundary portion between the insulator nose length portion and tapered portion is likely to occur for the following reasons.

That is, when a shock is applied to the spark plug along with an operation (vibration) of the internal combustion engine, stress is applied particularly to a region of the insulator in which there is a sharp change in outside diameter. Because of this, stress is applied concentrically to the boundary portion between the insulator nose length portion and tapered portion in which there is a sharp change in outside diameter. Herein, in the highly efficient engine, the insulator is more likely to be overheated, and stress applied to the insulator is also high. Consequently, as the boundary portion, by being overheated, is likely to take on a condition in which the mechanical strength thereof is decreased, an insulator crack is likely to occur in the boundary due to a high stress being applied to the boundary portion in this condition.

Furthermore, the heat of the insulator, by being transmitted from the tapered portion to the shoulder portion of the metal shell, is dissipated to the engine side. Because of this, the tapered portion and a region positioned close thereto are more easily rapidly cooled. Meanwhile, in the highly efficient engine, the insulator is heated to a higher temperature, as heretofore described. Because of this, a large thermal shock is applied to the tapered portion and the region positioned close thereto. As a result of this, there is concern that, due to a large thermal shock being applied thereto, an insulator crack occurs in the boundary portion between the insulator nose length portion and tapered portion, positioned close to the tapered portion, which is comparatively thin walled (comparatively low in mechanical strength).

Further, an insulator crack in the heretofore described kind of boundary portion is of particular concern in a spark plug which is reduced in diameter and whose insulator is comparatively thin walled.

SUMMARY OF THE INVENTION

The invention has been contrived bearing in mind the heretofore described circumstances, and an object of the invention lies in providing a spark plug reduced in diameter, wherein by preventing overheat of a boundary portion between an insulator nose length portion and a tapered portion, and mitigating a thermal shock applied to the boundary portion, an insulator crack in the boundary portion is more reliably prevented, thus realizing a superior durability.

Hereafter, an itemized description will be given of each configuration suitable for achieving the object. Working effects specific to the corresponding configurations are quoted as necessary.

Configuration 1. A spark plug of this configuration includes an insulator having an axial hole extending in a direction of an axis;

a center electrode inserted in a forward end portion of the axial hole; and a hollow cylindrical metal shell disposed on the outer periphery of the insulator, the insulator including an insulator nose length portion positioned in a forward end portion of the insulator, and a tapered portion, extending from the rear end of the insulator nose length portion toward a rear end of the insulator in the axis direction, increased in diameter toward the rear end of the insulator in the axis direction, and the metal shell includes a shoulder portion, protruding inward in a radial direction, having a retaining surface by which the tapered portion is directly or indirectly retained, and a male thread portion, positioned on the outer peripheral side of the shoulder portion, for bringing the spark plug into threaded engagement with amounting hole of a combustion device, wherein the thread diameter of the male thread portion is M12 or less, and when the area of a cross section of the insulator, perpendicular to the axis, passing through a boundary between the insulator nose length portion and the tapered portion is B ($mm^2$), and the area of a cross section of the metal shell, perpendicular to the axis, passing through the forward end of the retaining surface is C ($mm^2$), $2.80 \leq C/B \leq 3.50$ is satisfied.

According to the configuration 1, the thread diameter of the male thread portion is set to M12 or less, and the spark plug is thus reduced in diameter. Because of this, a crack of the insulator in a boundary portion between the insulator nose length portion and tapered portion is of more concern.

In this regard, according to the configuration 1, when the area of a cross section of the insulator, perpendicular to the axis, passing through the boundary between the insulator nose length portion and tapered portion is B ($mm^2$), and the area of a cross section of the metal shell, perpendicular to the axis, passing through the forward end of the retaining surface is C ($mm^2$), a configuration is adopted such that $C/B \leq 3.50$ is satisfied. That is, a configuration is such that the cross-sectional area C appropriate to the length of a heat dissipation path when the heat of the insulator is transmitted to a combustion device is not excessively larger than the cross-sectional area B appropriate to the amount of heat received by the boundary portion. Consequently, it is possible to rapidly transmit the heat of the boundary portion to the combustion device, and thus possible to more reliably suppress overheat of the boundary portion. As a result of this, it is possible to more reliably prevent the mechanical strength of the boundary portion from decreasing, and thus possible to effectively prevent an insulator crack when stress is applied.

Meanwhile, when the cross-sectional area C is reduced to excess (when the length of the heat dissipation path when the heat of the insulator is transmitted to the combustion device is extremely short), the boundary portion is very rapidly cooled. Because of this, a large thermal shock is applied to the boundary portion, and there is concern that a crack of the insulator occurs in the boundary portion.

In this regard, according to the configuration 1, a configuration is adopted such that $2.80 \leq C/B$ is satisfied. Because of this, it is possible to prevent the boundary portion from being rapidly cooled, and thus possible to mitigate a thermal shock applied to the boundary portion. As a result of this, it is possible to more reliably prevent a crack of the insulator in the boundary portion caused by the thermal shock.

As above, according to the configuration 1, it is possible, in the boundary portion between the insulator nose length portion and tapered portion, to achieve both suppression of a decrease in mechanical strength due to overheat and mitigation of a thermal shock. As a result of this, it is possible to effectively suppress a crack of the insulator in the boundary portion, and thus possible to realize a superior durability.

Configuration 2. With this configuration, the spark plug according to the configuration 1 is such that the insulator includes a middle barrel portion, extending from the rear end of the tapered portion toward the rear end of the insulator in the axis direction, larger in diameter than the insulator nose length portion, and an increased diameter portion, extending from the rear end of the middle barrel portion toward the rear end of the insulator in the axis direction, the outside diameter of which is increased toward the rear end of the insulator in the axis direction, wherein when the area of a cross section of the insulator, perpendicular to the axis, passing through a boundary between the middle barrel portion and increased diameter portion is A ($mm^2$), and the mass of the spark plug is M (g), $M/A \leq 1.40$ ($g/mm^2$) is satisfied.

As heretofore described, when a shock due to a vibration or the like is applied, stress is applied to a region of the insulator in which there is a sharp change in outside diameter. Because of this, stress is also applied concentrically to a boundary portion between the middle barrel portion and increased diameter portion in which there is a sharp change in outside diameter. In this boundary portion, overheat, an application of a large shock, and the like, are unlikely to occur, but there is concern that a crack of the insulator occurs due to the concentration of stress.

In this regard, according to the configuration 2, when the mass of the spark plug is M (g), and the area of a cross section of the insulator, perpendicular to the axis, passing through the boundary between the middle barrel portion and increased diameter portion is A ($mm^2$), a configuration is adopted such that $M/A \leq 1.40$ ($g/mm^2$) is satisfied. That is, stress corresponding to the mass M is applied to the boundary portion between the middle barrel portion and increased diameter portion when a shock is applied, while the cross-sectional area A appropriate to the mechanical strength of the boundary portion is made large enough, meaning that it is possible for the boundary portion to sufficiently resist the stress. As a result of this, it is possible to more reliably prevent a crack of the insulator in the boundary portion between the middle barrel portion and increased diameter portion, and thus possible to realize a more superior durability in combination with the effect of suppression of a crack of the insulator in the boundary portion between the insulator nose length portion and tapered portion which is achieved by the configuration 1.

Configuration 3. With this configuration, the spark plug according to the configuration 1 is such that the insulator includes a middle barrel portion, extending from the rear end of the tapered portion toward the rear end of the insulator in the axis direction, larger in diameter than the insulator nose length portion, an increased diameter portion, extending from the rear end of the middle barrel portion toward the rear end of the insulator in the axis direction, the outside diameter of which is increased toward the rear end of the insulator in the axis direction, a large diameter portion, extending from the rear end of the increased diameter portion toward the rear end of the insulator in the axis direction, larger in diameter than the middle barrel portion, and a reduced diameter portion, extending from the rear end of the large diameter portion toward the rear end of the insulator in the axis direction, the outside diameter of which is reduced toward the rear end of the insulator in the axis direction, wherein when a straight line connecting a boundary point between the visible outline of the large diameter portion and the visible outline of the reduced diameter portion and the boundary point between the visible outline of the middle barrel portion and the visible outline of the increased diameter portion is taken to be a straight line L1, a straight line connecting a boundary point between the visible outline of the middle barrel portion and the visible outline of the increased diameter portion and a boundary point between the visible outline of the insulator nose length portion and the visible outline of the tapered portion is taken to be a straight line L2, on a section including the axis, and the degree of a smaller angle of the angles formed by the straight line L1 and straight line L2 is taken to be G, $G \geq 163°$ is satisfied.

According to the configuration 3, a configuration is adopted such that $G \geq 163°$ is satisfied, and a configuration is adopted such that an outside diameter of the insulator in the region from the middle barrel portion to the increased diameter portion changes gradually. Consequently, it is possible to disperse stress applied to the boundary portion between the middle barrel portion and increased diameter portion. As a result of this, it is possible to still more reliably suppress a crack of the insulator in the boundary portion between the middle barrel portion and increased diameter portion, and thus possible to achieve a further improvement in durability.

Configuration 4. With this configuration, the spark plug according to the configuration 1 is such that when a length of the insulator nose length portion along the axis is K (mm), and the mass of the spark plug is M (g), $(M/B)\cdot K \leq 25.0$ (g/mm) is satisfied.

According to the configuration 4, when the length of the insulator nose length portion is K (mm), and the mass of the spark plug is M (g), a configuration is adopted such that $(M/B)\cdot K \leq 25.0$ (g/mm) is satisfied. That is, stress corresponding to the product of the mass M and length K is applied to the boundary portion between the middle barrel portion and increased diameter portion when a shock is applied to the insulator, while the cross-sectional area B appropriate to the mechanical strength of the boundary portion is made large enough to satisfy $(M/B)\cdot K \leq 25.0$. Because of this, it is possible for the boundary portion to sufficiently resist the stress. Consequently, it is possible to still more reliably prevent a crack of the insulator in the boundary portion between the insulator nose length portion and tapered portion, and thus possible to still further improve durability.

Configuration 5. With this configuration, the spark plug according to the configuration 1 is such that the insulator includes a middle barrel portion, extending from the rear end of the tapered portion toward the rear end of the insulator in the axis direction, larger in diameter than the insulator nose length portion, and an increased diameter portion, extending from the rear end of the middle barrel portion toward the rear end of the insulator in the axis direction, the outside diameter of which is increased toward the rear end of the insulator in the axis direction, and glass seal portions, formed by a glass powder mixture containing glass powder being sintered, which fix the insulator and at least one of the center electrode and a terminal electrode are provided in the axis hole, wherein the rear end of the glass seal portions is positioned closer to the forward end of the insulator in the axis direction than the boundary between the middle barrel portion and increased diameter portion.

There is a case in which the glass seal portions are provided in the axis hole in order to fix the center electrode and insulator together. Herein, the glass seal portions are formed by sintering a glass powder mixture, and when sintering, thermal stress is applied to the insulator positioned on the outer periphery of the glass seal portions. At this time, when the boundary portion between the middle barrel portion and increased diameter portion is positioned on the outer periphery of the glass seal portions, there is concern that the mechanical strength of the boundary portion decreases due to the thermal stress despite the fact that the boundary portion is a region requiring a high mechanical strength in order to resist the concentration of stress.

In this regard, according to the configuration 5, a configuration is adopted such that the rear end of the glass seal portions is positioned closer to the forward end of the insulator in the axis direction than the boundary between the middle barrel portion and increased diameter portion. That is, a configuration is adopted such that the glass seal portions are not disposed on the inner peripheral side of the boundary. Consequently, it is possible to adopt an arrangement such that, when sintering, no thermal stress from the glass seal portions is applied to the boundary portion between the middle barrel portion and increased diameter portion. As a result of this, it is possible to more reliably suppress a decrease in strength of the boundary portion, and thus possible to more effectively prevent a crack of the insulator in the boundary portion.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 2 is an enlarged sectional view showing a portion of an insulator retained on a metal shell, and the like.

FIG. 4 is an enlarged sectional view showing a middle barrel portion, an increased diameter portion, and the like.

FIG. 7 is an enlarged sectional view of a forward end portion of the insulator showing a length K of the insulator nose length portion, and the like.

DETAILED DESCRIPTION OF THE INVENTION

Figure 1:
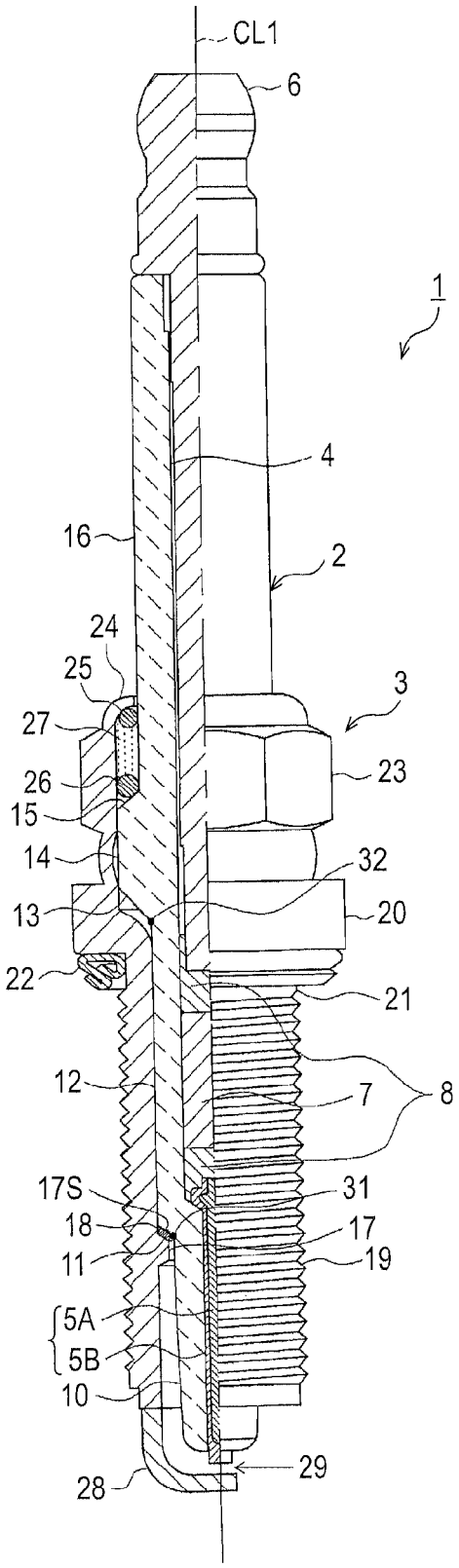
FIG. 1 is a partially sectioned front view showing a configuration of a spark plug.

Hereafter, a description will be given, while referring to the drawings, of one embodiment. FIG. 1 is a partially sectioned front view showing a spark plug 1. In FIG. 1, a description will be given with a direction of an axis CL1 of the spark plug 1 as an up-down direction in the drawing, the lower side as the forward end side of the spark plug 1, and the upper side as the rear end side.

The spark plug 1 is configured of a hollow cylindrical insulator 2 acting as an insulating body, a hollow cylindrical metal shell 3 disposed on the outer periphery of the insulator 2, and the like.

The insulator 2, being formed by sintering alumina or the like, as is well known, includes in the external portion thereof an insulator nose length portion 10, a tapered portion 11, a middle barrel portion 12, an increased diameter portion 13, a large diameter portion 14, a reduced diameter portion 15, and a rear end side barrel portion 16, being introduced in order from the forward end side.

The insulator nose length portion 10, being formed in a forward end portion of the insulator 2, is configured in such a way that at least an outside diameter thereof on the forward end side is gradually increased toward the rear end of the insulator in the axis CL1 direction. The tapered portion 11, extending from the rear end of the insulator nose length portion 10 toward rear end of the insulator in the axis CL1 direction, is configured in such a way that the outside diameter thereof is increased toward the rear end of the insulator in the axis CL1 direction. The middle barrel portion 12, extending from the rear end of the tapered portion 11 toward the rear end of the insulator in the axis CL1 direction, is configured in such a way as to be larger in diameter than the insulator nose length portion 10, and have a constant outside diameter in the axis CL1 direction. The increased diameter portion 13, extending from the rear end of the middle barrel portion 12 toward the rear end of the insulator in the axis CL1 direction, is configured in such a way that the outside diameter thereof is increased toward the rear end of the insulator in the axis CL1 direction. The large diameter portion 14, extending from the rear end of the increased diameter portion 13 toward the rear end of the insulator in the axis CL1 direction, is configured in such a way as to be larger in diameter than the middle barrel portion 12, and have a constant outside diameter in the axis CL1 direction. The reduced diameter portion 15, extending from the rear end of the large diameter portion 14 toward the rear end of the insulator in the axis CL1 direction, is configured in such a way that the outside diameter thereof is reduced toward the rear end of the insulator in the axis CL1 direction. The rear end side barrel portion 16, extending from the rear end of the reduced diameter portion 15 toward the rear end of the insulator in the axis CL1 direction, is configured in such a way that a large portion thereof has a constant outside diameter along the axis CL1.

In addition, a forward end portion of the insulator nose length portion 10 and a region other than the ultimate forward end portion of the rear end side barrel portion 16, of the insulator 2, are exposed outside the metal shell 3, and the tapered portion 11, middle barrel portion 12, large diameter portion 14, and the like, of the insulator 2 are housed inside the metal shell 3. Also, the insulator 2 is retained on the metal shell 3 by the tapered portion 11.

Furthermore, an axial hole 4 extending along the axis CL1 is formed in the insulator 2 so as to pass through the insulator 2, and a center electrode 5 is inserted in a forward end portion of the axial hole 4. The center electrode 5 includes an inner layer 5A formed from a metal superior in thermal conductivity (for example, copper, a copper alloy, or pure nickel (Ni)) and an outer layer 5B formed from a Ni-based Ni alloy. Also, the center electrode 5 has a bar-like (cylindrical) shape as a whole, and a forward end portion thereof protrudes from the forward end of the insulator 2.

In addition, a terminal electrode 6 is inserted and fixed in a rear end portion of the axial hole 4 in a condition in which it protrudes from the rear end of the insulator 2.

Furthermore, a cylindrical conductive resistor 7 is disposed in a space of the axial hole 4 between the center electrode 5 and terminal electrode 6. Conductive glass seal portions 8 wherein a glass powder mixture containing a conducting substance, glass powder, and the like, are sintered in a compressed state are provided on both end sides of the resistor 7 in the axial hole 4. The insulator 2 and the center electrode 5 and terminal electrode 6 are fixed together, and the center electrode 5 and terminal electrode 6 are electrically connected together, by the glass seal portions 8.

In addition, the metal shell 3 is formed in a hollow cylindrical shape from a metal such as a low carbon steel, and a shoulder portion 17 protruding inward in a radial direction is formed on the inner periphery of the metal shell 3. The shoulder portion 17 includes a retaining surface 17S by which the tapered portion 11 is directly or indirectly retained, and in the embodiment, the tapered portion 11 is indirectly retained by the retaining surface 17S across an annular plate packing 18. By providing the plate packing 18 between the tapered portion 11 and shoulder portion 17, the interior of a combustion chamber is maintained airtight, thus preventing a fuel gas infiltrating into a space between the insulator 2 nose length portion 10 and metal shell 3 inner peripheral surface exposed inside the combustion chamber from leaking to the exterior.

Furthermore, a male thread portion 19 for bringing the spark plug 1 into threaded engagement with a mounting hole of a combustion device (for example, an internal combustion engine or a fuel cell reformer) is formed on an outer peripheral surface of the metal shell 3, and at least one portion of the male thread portion 19 is positioned on the outer peripheral side of the shoulder portion 17. Also, a seat portion 20 is formed on the rear end side of the male thread portion 19 so as to protrude toward the outer peripheral side, and a ring-like gasket 22 is fitted over a thread neck 21 at the rear end of the male thread portion 19. Furthermore, a tool engagement portion 23 of hexagonal cross section for engaging a tool such as a wrench when mounting the metal shell 3 in the combustion device is provided on the rear end side of the metal shell 3. Also, a caulked portion 24 bent inward in the radial direction is provided at the rear end portion of the metal shell 3.

Furthermore, the insulator 2 is inserted into the metal shell 3 from the rear end side toward the forward end side of the metal shell 3, and fixed to the metal shell 3 by caulking a rear end side opening portion of the metal shell 3 inward in the radial direction, that is, forming the caulked portion 24, in a condition in which the tapered portion 11 of the insulator 2 is retained by the shoulder portion 17 across the plate packing 18.

Also, in order to make a caulking seal more complete, annular ring members 25 and 26 are interposed between the metal shell 3 and insulator 2 on the rear end side of the metal shell 3, and a space between the ring members 25 and 26 is filled with talc 27 powder. That is, the metal shell 3 holds the insulator 2 across the plate packing 18, ring members 25 and 26, and talc 27.

Also, a bar-like ground electrode 28 bent back in a substantially intermediate portion is joined to a forward end portion of the metal shell 3. In addition, a spark discharge gap 29 is formed between a forward end portion of the ground electrode 28 and a forward end portion of the center electrode 5, and an arrangement is such that, in the spark discharge gap 29, a spark discharge occurs in a direction substantially along the axis CL1.

Furthermore, in the embodiment, in order to achieve a reduction in size (diameter) of the spark plug 1, the metal shell 3 is reduced in diameter, and the thread diameter of the male thread portion 19 is set to M12 or less. In addition, along with the reduction in diameter of the metal shell 3, the insulator 2 disposed on the inner periphery of the metal shell 3 is also reduced in diameter, and the insulator 2 is formed to be comparatively thin walled.

However, when a shock due to a vibration or the like is applied to the spark plug 1, stress is transmitted to the insulator 2 via the metal shell 3, and a high stress is applied particularly to a region of the insulator 2 in which there is a sharp change in outside diameter. Because of this, stress is applied concentrically to a boundary portion 31 between the insulator nose length portion 10 and tapered portion 11 in which there is a sharp change in outside diameter. Further, the boundary portion 31 is overheated along with an operation of the combustion device, and when stress is applied to the insulator 2 in a condition in which the mechanical strength of the boundary portion 31 is decreased, there is concern that a crack of the insulator 2 occurs in the boundary portion 31 in combination with the fact that the insulator 2 is comparatively thin walled, too, as heretofore described.

Figure 2:
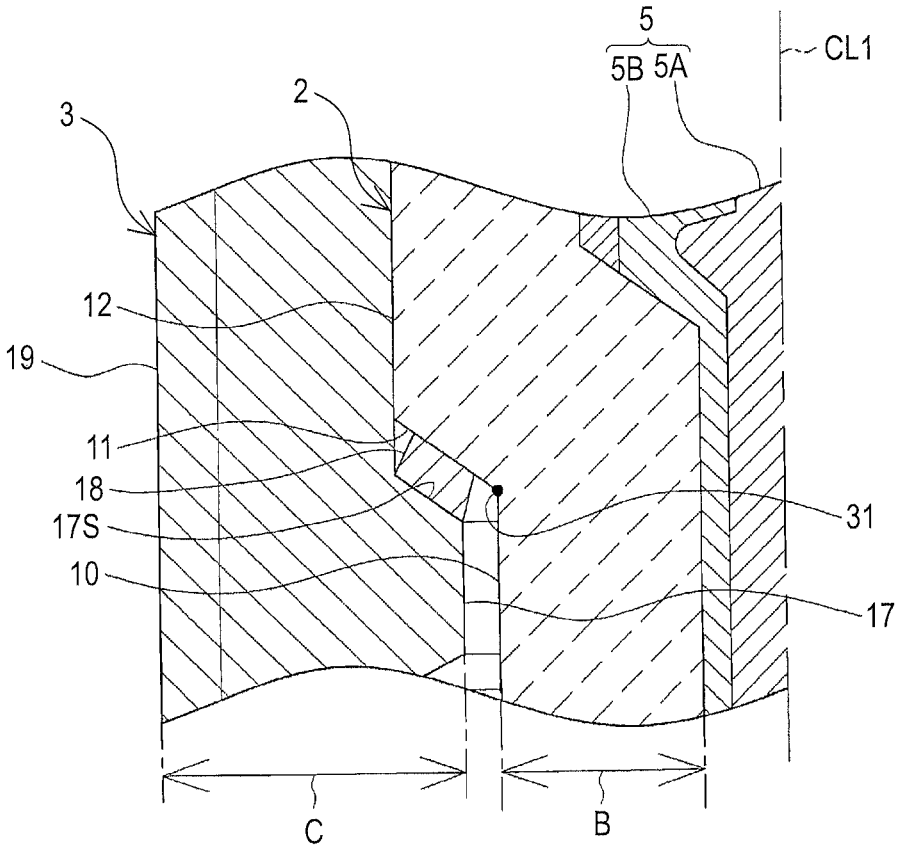

Therefore, in the embodiment, in order to prevent the crack of the insulator 2 in the boundary portion 31 caused by the decrease in strength due to the overheat, when the area of a cross section of the insulator 2, perpendicular to the axis CL1, passing through the boundary between the insulator nose length portion 10 and tapered portion 11 is B ($mm^2$), and the area of a cross section of the metal shell 3, perpendicular to the axis CL1, passing through the forward end of the retaining surface 17S is C ($mm^2$), as shown in FIG. 2, a configuration is adopted such that C/B≤3.50 is satisfied.

Meanwhile, when the cross-sectional area C is reduced to excess (when the length of a heat dissipation path when the heat of the insulator 2 is transmitted to the combustion device side is extremely short), the boundary portion 31 is very rapidly cooled. Because of this, a large thermal shock is applied to the boundary portion 31, and there is concern that a crack of the insulator 2 occurs in the boundary portion 31.

Bearing in mind this point, in the embodiment, a configuration is adopted such that 2.80≤C/B is satisfied in order to mitigate the thermal shock applied to the boundary portion 31.

The cross-sectional area C can be computed by subtracting the area of a circle with the inside diameter of the forward end of the retaining surface 17S as its diameter from the area of a circle with the outside diameter of the crest portion of the male thread portion 19 as its diameter.

Figure 3:
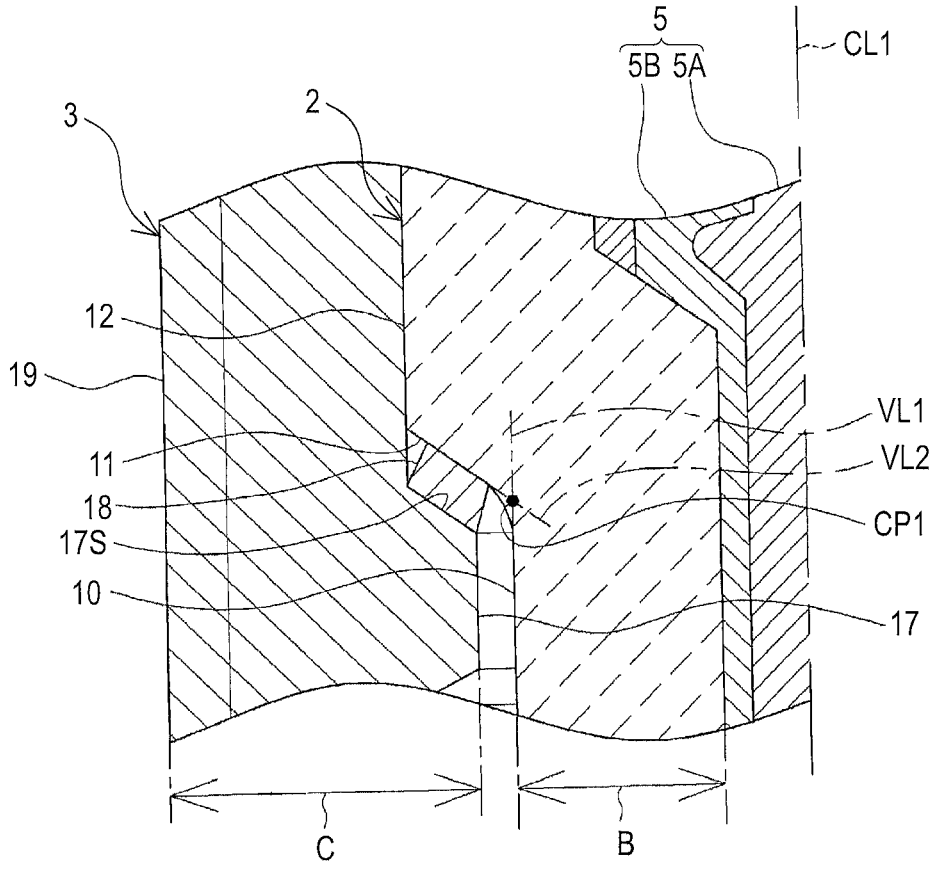
FIG. 3 is an enlarged sectional view for illustrating a boundary between an insulator nose length portion and a tapered portion when a visible outline from the insulator nose portion to the tapered portion is curved.

Also, when the visible outline of a region from the insulator nose length portion 10 to the tapered portion 11 is curved on a section including the axis CL1, as shown in FIG. 3, the boundary between the insulator nose length portion 10 and tapered portion 11 (a boundary point P3 to be described hereafter) refers to a point of intersection CP1 between a virtual straight line VL1 and a virtual straight line VL2, both to be described next, on the section. The virtual straight line VL1 refers to a straight line formed by a linear visible outline of the insulator nose length portion 10 visible outline positioned immediately on the forward end side of the curved region being extended toward the axis CL1 direction rear end side. Also, the virtual straight line VL2 refers to a straight line formed by a linear visible outline of the tapered portion 11 visible outline positioned immediately on the rear end side of the curved region being extended toward the forward end of the insulator in the axis CL1 direction.

In addition, as a high stress is applied particularly to a region of the insulator 2 in which there is a sharp change in outside diameter when a shock is applied to the insulator 2, as described heretofore, a crack of the insulator 2 in a boundary portion 32 between the middle barrel portion 12 and insulator nose length portion 13 is also of concern.

Figure 4:
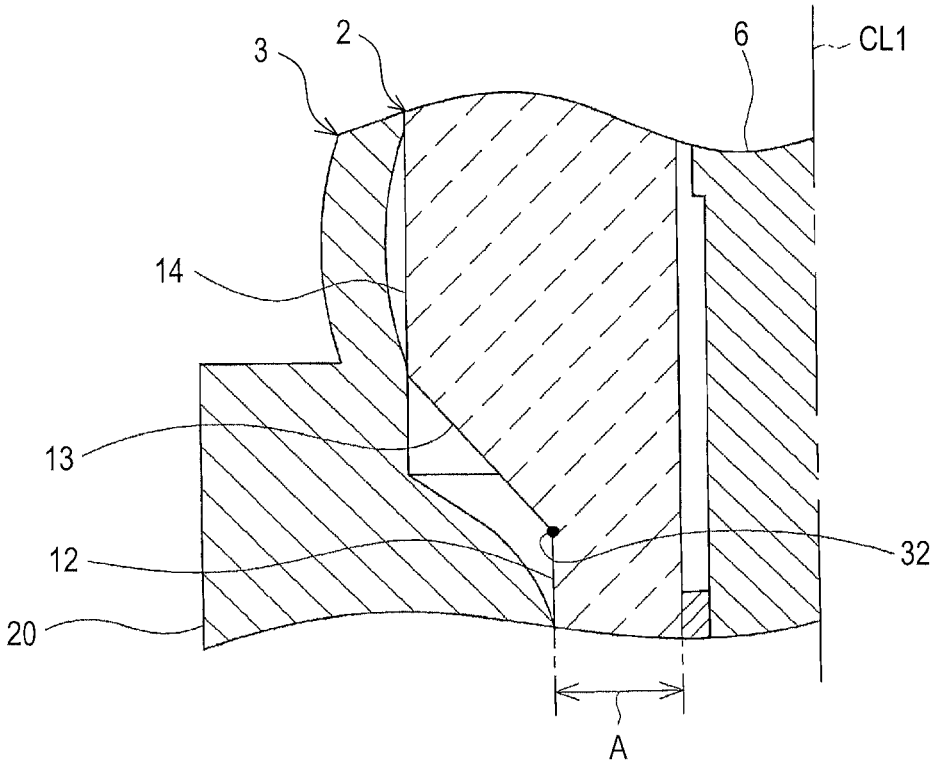

In this regard, in the embodiment, in order to prevent a crack of the insulator 2 in the boundary portion 32, when the mass of the spark plug 1 is M (g), and as shown in FIG. 4, the area of a cross section of the insulator, perpendicular to the axis CL1, passing through the boundary between the middle barrel portion 12 and increased diameter portion 13 is A ($mm^2$), a configuration is adopted such that M/A≤1.40 ($g/mm^2$) is satisfied.

Figure 5:
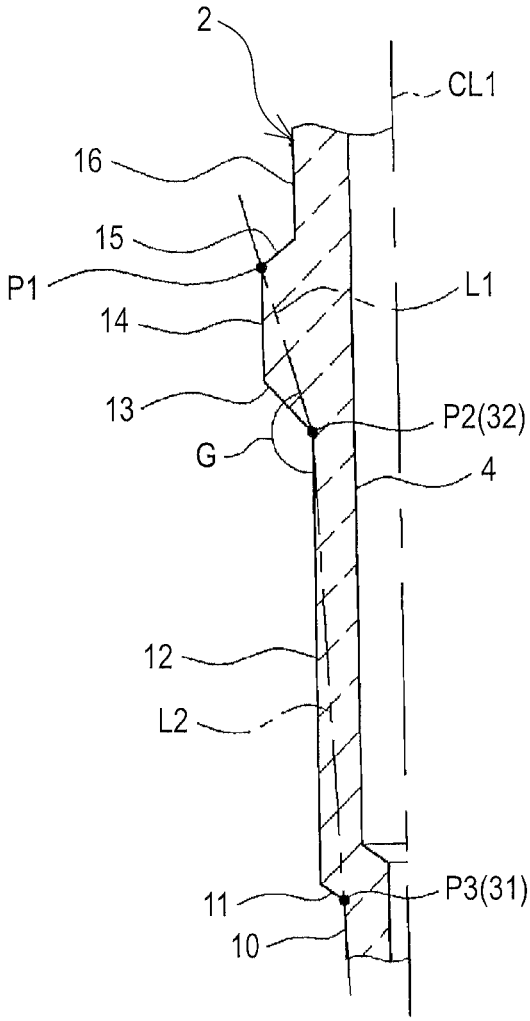
FIG. 5 is an enlarged sectional view of an insulator for illustrating an angle G.

Furthermore, in order to achieve a decrease in stress applied to the boundary portion 32, when a smaller angle of the angles formed by a straight line L1 and a straight line L2, both to be described next, is taken to be G, as shown in FIG. 5 (only the insulator 2 is shown in FIG. 5), a configuration is adopted such that G≥163° is satisfied. The straight line L1 refers to a straight line connecting a boundary point P1 between the visible outline of the large diameter portion 14 and the visible outline of the reduced diameter portion 15, and a boundary point P2 between the visible outline of the meddle barrel portion 12 and the visible outline of the increased diameter portion 13, on a section including the axis CL1. Also, the straight line L2 refers to a straight line connecting the boundary point P2 and the boundary point P3 between the visible outline of the insulator nose length portion 10 and the visible outline of the tapered portion 11 on the section including the axis CL1.

Figure 6:
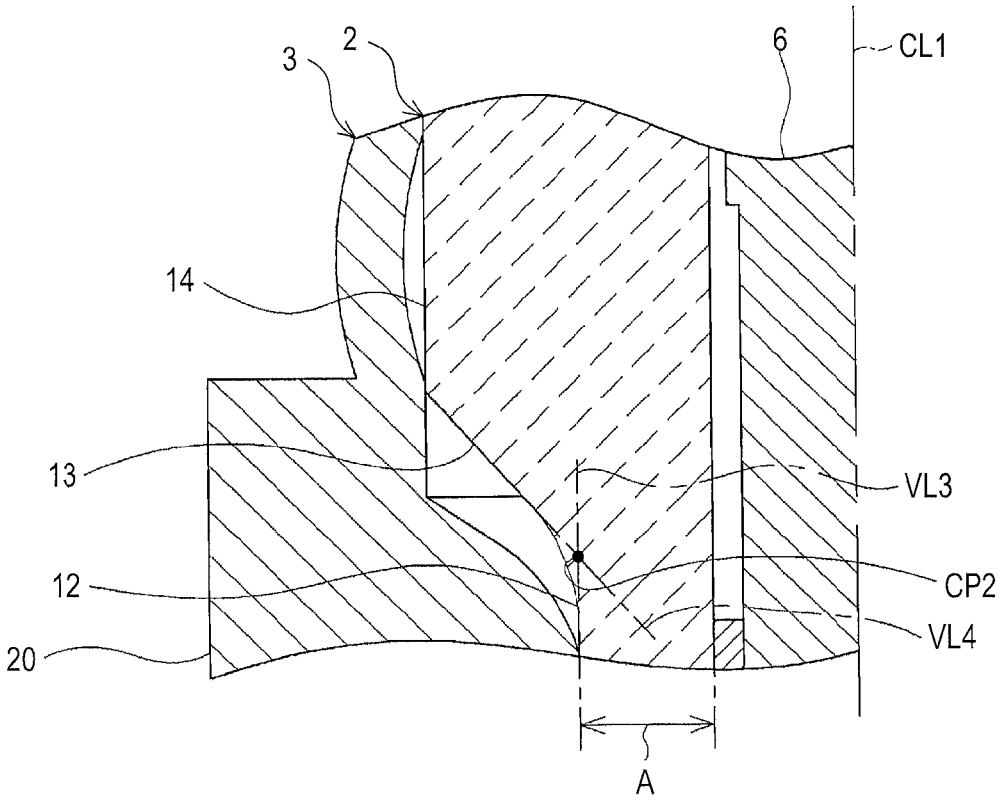
FIG. 6 is an enlarged sectional view for illustrating a boundary portion between the middle barrel portion and a curved portion when a visible outline from the middle barrel portion to the curved portion is curved.

When the visible outline of a region from the middle barrel portion 12 to the increased diameter portion 13 is curved on a section including the axis CL1, as shown in FIG. 6, the boundary (boundary point P2) between the middle barrel portion 12 and increased diameter portion 13 refers to a point of intersection CP2 between a virtual straight line VL3 and a virtual straight line VL4, both to be described next, on the section. Herein, the virtual straight line VL3 refers to a straight line formed by a linear visible outline of the middle barrel portion 12 visible outline positioned immediately on the forward end side of the curved region being extended toward the rear end of the insulator in the axis CL1 direction. Also, the virtual straight line VL4 refers to a straight line formed by a linear visible outline of the increased diameter portion 13 visible outline positioned immediately on the rear end side of the curved region being extended toward the forward end of the insulator in the axis CL1 direction.

Furthermore, when the visible outline of a region from the large diameter portion 14 to the reduced diameter portion 15 is curved on the section including the axis CL1, the boundary point P1 refers to a point of intersection between a virtual straight line formed by a linear visible outline of the large diameter portion 14 visible outline positioned immediately on the forward end side of the curved region being extended toward the axis CL1 direction rear end side and a virtual straight line formed by a linear visible outline of the reduced diameter portion 15 visible outline positioned immediately on the rear end side of the curved region being extended toward the forward end of the insulator in the axis CL1 direction.

Figure 7:
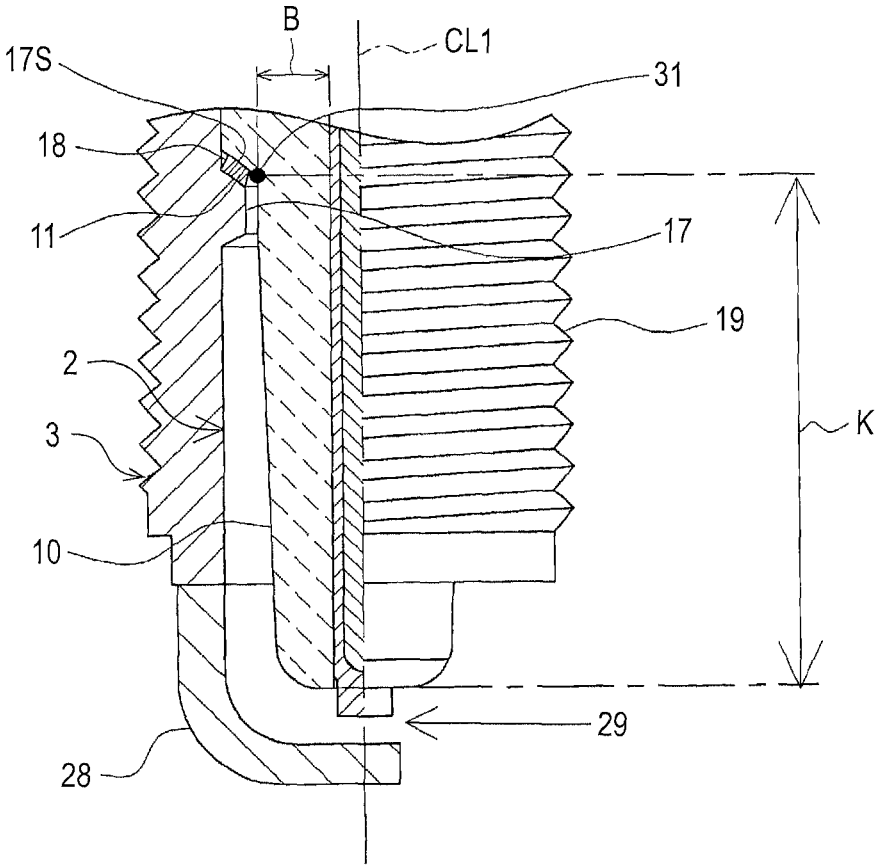

In addition, in the embodiment, in order to more reliably prevent a crack of the insulator 2 in the boundary portion 31 when a shock is applied, when a length of the insulator nose length portion 10 along the axis CL1 is K (mm), as shown in FIG. 7, a configuration is adopted such that (M/B)·K≤25.0 (g/mm) is satisfied (as heretofore described, M is the mass of the spark plug 1, and B is the area of a cross section of the insulator 2, perpendicular to the axis CL1, passing through the boundary between the insulator nose length portion 10 and tapered portion 11).

Moreover, in the embodiment, in order to increase the mechanical strength of the boundary portion 32 and more reliably prevent a crack of the insulator 2 in the boundary portion 32, a configuration is adopted such that the rear end of the glass seal portions 8 is positioned closer to the forward end of the insulator in the axis CL1 direction than the boundary (boundary portion 32) between the middle barrel portion 12 and increased diameter portion 13, as shown in FIG. 1. That is, a configuration is adopted such that the glass seal portions 8 are not disposed on the inner peripheral side of the boundary portion 32.

As heretofore described in detail, according to the embodiment, a configuration is adopted such that C/B≤3.50 is satisfied. That is, a configuration is such that the cross-sectional area C appropriate to the length of the heat dissipation path when the heat of the insulator 2 is transmitted to the combustion device is not excessively larger than the cross-sectional area B appropriate to the amount of heat received by the boundary portion 31. Consequently, it is possible to rapidly transmit the heat of the boundary portion 31 to the combustion device, and thus possible to more reliably suppress overheat of the insulator 2. As a result of this, it is possible to more reliably prevent the mechanical strength of the insulator 2 from decreasing in the boundary portion 31, and thus possible to effectively prevent a crack of the insulator 2 when stress is applied.

Meanwhile, in the embodiment, as a configuration is adopted such that 2.80≤C/B is satisfied, it is possible to prevent the boundary portion 31 from being rapidly cooled. As a result of this, it is possible to more reliably prevent a crack of the insulator 2 in the boundary portion 31.

As above, according to the embodiment, it is possible, in the boundary portion 31 between the insulator nose length portion 10 and tapered portion 11, to achieve both suppression of a decrease in mechanical strength due to overheat and mitigation of a thermal shock. As a result of this, it is possible to effectively suppress a crack of the insulator in the boundary portion 31, and thus possible to realize a superior durability.

Furthermore, in the embodiment, a configuration is adopted such that (M/B)·K≤25.0 (g/mm) is satisfied. That is, stress corresponding to the product of the mass M and length K is applied to the boundary portion 31 when a shock is applied to the insulator 2, while the cross-sectional area B appropriate to the mechanical strength of the boundary portion 31 is made large enough to satisfy (M/B)·K≤25.0. Because of this, it is possible for the boundary portion 31 to sufficiently resist the stress. Consequently, it is possible to still more reliably suppress a crack of the insulator 2 in the boundary portion 31, and thus possible to still further improve durability.

Also, in the embodiment, a configuration is adopted such that M/A≤1.40 (g/mm$^2$) is satisfied. That is, stress corresponding to the mass M is applied to the boundary portion 32 between the middle barrel portion 12 and increased diameter portion 13 when a shock is applied, while the cross-sectional area A appropriate to the mechanical strength of the boundary portion 32 is made large enough. Because of this, it is possible for the boundary portion 32 to sufficiently resist the stress. As a result of this, it is possible to more reliably prevent a crack of the insulator 2 in the boundary portion 32, and thus possible to realize a more superior durability in combination with the effect of suppression of a crack of the insulator 2 in the boundary portion 31.

In addition, a configuration is adopted such that G≥163° is satisfied, and a configuration is adopted such that an outside diameter of the insulator 2 in the region from the middle barrel portion 12 to the increased diameter portion 13 changes gradually. Consequently, it is possible to disperse stress applied to the boundary portion 32. As a result of this, it is possible to still more reliably suppress a crack of the insulator 2 in the boundary portion 32, and thus possible to achieve a further improvement in durability.

Moreover, a configuration is adopted such that the rear end of the glass seal portions 8 is positioned closer to the forward end of the insulator in the axis CL1 direction than the boundary between the middle barrel portion 12 and increased diameter portion 13, and a configuration is adopted such that the glass seal portions 8 are not disposed on the inner peripheral side of the boundary. Consequently, it is possible to adopt an arrangement such that, when sintering, no thermal stress from the glass seal portions 8 is applied to the boundary portion 32. As a result of this, it is possible to more reliably suppress a decrease in strength of the boundary portion 32, and thus possible to more effectively prevent a crack of the insulator 2 in the boundary portion 32.

Next, in order to confirm the working effects achieved by the embodiment, spark plug samples wherein, after the thread diameter of the male thread portion is set to M10 or M12, the value of C/B is changed by variously changing the cross-sectional areas B and C (mm$^2$), are fabricated, and an actual engine thermal test and a hot shock test are carried out on each sample.

The outline of the actual engine thermal test is as follows. That is, after mounting samples in a predetermined engine, a thermal cycle wherein the interior of the combustion chamber is heated until pre-ignition occurs, and next, the engine is placed in an idling condition, is repetitively carried out ten times. Subsequently, the insulator of each sample is observed to confirm the presence or absence of a crack in the insulator (particularly, in the boundary portion between the insulator nose length portion and tapered portion).

Also, the outline of the hot shock test is as follows. That is, samples are mounted in a predetermined bush whose interior is air cooled. After that, while heating a forward end portion of the insulator of each sample (a region thereof positioned close to the spark discharge gap) to 900° C. with a burner, a shock test (stroke: 22 mm) in accordance with the impact resistance test stipulated in JIS B8031 is carried out to apply a shock to each sample for one hour. Subsequently, the insulator of each sample is observed to confirm the presence or absence of a crack in the insulator (particularly, in the boundary portion between the insulator nose length portion and tapered portion).

Results of the two tests on samples with the thread diameter set to M10 are shown in Table 1, and results of the two tests on samples with the thread diameter set to M12 are shown in Table 2. Sets of twenty samples with the same C/B are prepared, and the two tests are carried out one on each set of ten samples with the same C/B. Then, it is taken that a set of ten samples is given a "○" evaluation when no insulator crack is found in any of the ten samples, while a set of ten samples is given a "x" evaluation when an insulator crack is found in at least one of the ten samples. Also, an inside diameter D1 of the metal shell at the forward end of the retaining surface, an outside diameter D2 of the insulator in the boundary between the insulator nose length portion and tapered portion, and a forward end side opening diameter D3 of the axial hole are shown as reference in Tables 1 and 2. In addition, the opposite side dimension of the tool engagement portion of each sample is set to 14 mm.

TABLE 1

| Thread Diameter: M10 | | | | | | | |
|---|---|---|---|---|---|---|---|
| Inside Diameter D1 (mm) | Outside Diameter D2 (mm) | Opening Diameter D3 (mm) | Cross-sectional Area C (mm$^2$) | Cross-sectional Area B (mm$^2$) | C/B | Actual Engine Thermal Test | Hot Shock Test |
| 5.20 | 4.6 | 2.16 | 57.30 | 12.95 | 4.42 | ○ | X |
| 5.40 | 4.6 | 2.16 | 55.64 | 12.95 | 4.29 | ○ | X |
| 5.60 | 4.6 | 2.16 | 53.91 | 12.95 | 4.16 | ○ | X |
| 5.80 | 4.6 | 2.16 | 52.12 | 12.95 | 4.02 | ○ | X |
| 5.20 | 5.0 | 2.16 | 57.30 | 15.97 | 3.59 | ○ | X |
| 5.36 | 5.0 | 2.16 | 55.98 | 15.97 | 3.50 | ○ | ○ |
| 5.40 | 5.0 | 2.16 | 55.64 | 15.97 | 3.48 | ○ | ○ |
| 5.60 | 5.0 | 2.16 | 53.91 | 15.97 | 3.38 | ○ | ○ |

TABLE 1-continued

| Thread Diameter: M10 | | | | | | | |
|---|---|---|---|---|---|---|---|
| Inside Diameter D1 (mm) | Outside Diameter D2 (mm) | Opening Diameter D3 (mm) | Cross-sectional Area C ($mm^2$) | Cross-sectional Area B ($mm^2$) | C/B | Actual Engine Thermal Test | Hot Shock Test |
| 5.80 | 5.0 | 2.16 | 52.12 | 15.97 | 3.26 | ○ | ○ |
| 6.00 | 5.0 | 2.16 | 50.27 | 15.97 | 3.15 | ○ | ○ |
| 6.20 | 5.0 | 2.16 | 48.35 | 15.97 | 3.03 | ○ | ○ |
| 6.40 | 5.0 | 2.16 | 46.37 | 15.97 | 2.90 | ○ | ○ |
| 6.60 | 5.0 | 2.16 | 44.33 | 15.97 | 2.78 | X | ○ |
| 6.80 | 5.0 | 2.16 | 42.22 | 15.97 | 2.64 | X | ○ |
| 5.40 | 5.2 | 2.16 | 55.64 | 17.57 | 3.17 | ○ | ○ |
| 5.60 | 5.2 | 2.16 | 53.91 | 17.57 | 3.07 | ○ | ○ |
| 5.80 | 5.2 | 2.16 | 52.12 | 17.57 | 2.97 | ○ | ○ |
| 6.00 | 5.2 | 2.16 | 50.27 | 17.57 | 2.86 | ○ | ○ |
| 6.20 | 5.2 | 2.16 | 48.35 | 17.57 | 2.75 | X | ○ |
| 6.40 | 5.2 | 2.16 | 46.37 | 17.57 | 2.64 | X | ○ |
| 6.60 | 5.2 | 2.16 | 44.33 | 17.57 | 2.52 | X | ○ |
| 6.80 | 5.2 | 2.16 | 42.22 | 17.57 | 2.40 | X | ○ |
| 5.40 | 5.3 | 2.36 | 55.64 | 17.69 | 3.15 | ○ | ○ |
| 5.50 | 5.3 | 2.36 | 54.78 | 17.69 | 3.10 | ○ | ○ |
| 5.60 | 5.3 | 2.36 | 53.91 | 17.69 | 3.05 | ○ | ○ |
| 5.70 | 5.3 | 2.36 | 53.02 | 17.69 | 3.00 | ○ | ○ |
| 5.80 | 5.3 | 2.36 | 52.12 | 17.69 | 2.95 | ○ | ○ |
| 5.90 | 5.3 | 2.36 | 51.20 | 17.69 | 2.89 | ○ | ○ |
| 6.00 | 5.3 | 2.36 | 50.27 | 17.69 | 2.84 | ○ | ○ |
| 6.07 | 5.3 | 2.36 | 49.60 | 17.69 | 2.80 | ○ | ○ |
| 6.20 | 5.3 | 2.36 | 48.35 | 17.69 | 2.73 | X | ○ |
| 6.30 | 5.3 | 2.36 | 47.37 | 17.69 | 2.68 | X | ○ |
| 5.80 | 4.7 | 2.16 | 52.12 | 13.69 | 3.81 | ○ | X |
| 5.80 | 4.8 | 2.16 | 52.12 | 14.43 | 3.61 | ○ | X |
| 5.80 | 4.9 | 2.16 | 52.12 | 15.19 | 3.43 | ○ | ○ |
| 5.80 | 5.0 | 2.16 | 52.12 | 15.97 | 3.26 | ○ | ○ |
| 5.80 | 5.1 | 2.16 | 52.12 | 16.76 | 3.11 | ○ | ○ |
| 5.80 | 5.2 | 2.16 | 52.12 | 17.57 | 2.97 | ○ | ○ |
| 5.80 | 5.3 | 2.16 | 52.12 | 18.40 | 2.83 | ○ | ○ |
| 5.80 | 5.4 | 2.16 | 52.12 | 19.24 | 2.71 | X | ○ |
| 5.80 | 5.5 | 2.16 | 52.12 | 20.09 | 2.59 | X | ○ |

TABLE 2

| Thread Diameter: M12 | | | | | | | |
|---|---|---|---|---|---|---|---|
| Inside Diameter D1 (mm) | Outside Diameter D2 (mm) | Opening Diameter D3 (mm) | Cross-sectional Area C ($mm^2$) | Cross-sectional Area B ($mm^2$) | C/B | Actual Engine Thermal Test | Hot Shock Test |
| 6.20 | 5.7 | 2.16 | 82.91 | 21.85 | 3.79 | ○ | X |
| 6.40 | 5.7 | 2.16 | 80.93 | 21.85 | 3.70 | ○ | X |
| 6.60 | 5.7 | 2.16 | 78.89 | 21.85 | 3.61 | ○ | X |
| 6.80 | 5.7 | 2.16 | 76.78 | 21.85 | 3.51 | ○ | X |
| 6.90 | 5.7 | 2.16 | 75.70 | 21.85 | 3.46 | ○ | ○ |
| 7.00 | 5.7 | 2.16 | 74.61 | 21.85 | 3.41 | ○ | ○ |
| 6.20 | 6.0 | 2.16 | 82.91 | 24.61 | 3.37 | ○ | ○ |
| 6.40 | 6.0 | 2.16 | 80.93 | 24.61 | 3.29 | ○ | ○ |
| 6.60 | 6.0 | 2.16 | 78.89 | 24.61 | 3.21 | ○ | ○ |
| 6.80 | 6.0 | 2.16 | 76.78 | 24.61 | 3.12 | ○ | ○ |
| 7.00 | 6.0 | 2.16 | 74.61 | 24.61 | 3.03 | ○ | ○ |
| 7.20 | 6.0 | 2.16 | 72.38 | 24.61 | 2.94 | ○ | ○ |
| 7.40 | 6.0 | 2.16 | 70.09 | 24.61 | 2.85 | ○ | ○ |
| 7.60 | 6.0 | 2.16 | 67.73 | 24.61 | 2.75 | X | ○ |
| 7.80 | 6.0 | 2.16 | 65.31 | 24.61 | 2.65 | X | ○ |
| 8.00 | 6.0 | 2.16 | 62.83 | 24.61 | 2.55 | X | ○ |
| 6.20 | 6.0 | 2.56 | 82.91 | 23.13 | 3.58 | ○ | X |
| 6.40 | 6.0 | 2.56 | 80.93 | 23.13 | 3.50 | ○ | ○ |
| 6.60 | 6.0 | 2.56 | 78.89 | 23.13 | 3.41 | ○ | ○ |
| 6.80 | 6.0 | 2.56 | 76.78 | 23.13 | 3.32 | ○ | ○ |
| 7.00 | 6.0 | 2.56 | 74.61 | 23.13 | 3.23 | ○ | ○ |
| 7.20 | 6.0 | 2.56 | 72.38 | 23.13 | 3.13 | ○ | ○ |
| 7.40 | 6.0 | 2.56 | 70.09 | 23.13 | 3.03 | ○ | ○ |
| 7.60 | 6.0 | 2.56 | 67.73 | 23.13 | 2.93 | ○ | ○ |
| 7.80 | 6.0 | 2.56 | 65.31 | 23.13 | 2.82 | ○ | ○ |
| 7.85 | 6.0 | 2.56 | 64.70 | 23.13 | 2.80 | ○ | ○ |
| 7.30 | 5.3 | 2.16 | 71.24 | 18.40 | 3.87 | ○ | X |
| 7.30 | 5.4 | 2.16 | 71.24 | 19.24 | 3.70 | ○ | X |
| 7.30 | 5.5 | 2.16 | 71.24 | 20.09 | 3.55 | ○ | X |

TABLE 2-continued

| Thread Diameter: M12 | | | | | | | |
|---|---|---|---|---|---|---|---|
| Inside Diameter D1 (mm) | Outside Diameter D2 (mm) | Opening Diameter D3 (mm) | Cross-sectional Area C ($mm^2$) | Cross-sectional Area B ($mm^2$) | C/B | Actual Engine Thermal Test | Hot Shock Test |
| 7.30 | 5.5 | 2.16 | 71.24 | 20.35 | 3.50 | ○ | ○ |
| 7.30 | 5.6 | 2.16 | 71.24 | 20.97 | 3.40 | ○ | ○ |
| 7.30 | 5.7 | 2.16 | 71.24 | 21.85 | 3.26 | ○ | ○ |
| 7.30 | 5.8 | 2.16 | 71.24 | 22.76 | 3.13 | ○ | ○ |
| 7.30 | 5.9 | 2.16 | 71.24 | 23.68 | 3.01 | ○ | ○ |
| 7.30 | 6.0 | 2.16 | 71.24 | 24.61 | 2.89 | ○ | ○ |
| 7.30 | 6.1 | 2.16 | 71.24 | 25.56 | 2.79 | X | ○ |
| 7.30 | 6.2 | 2.16 | 71.24 | 26.53 | 2.69 | X | ○ |
| 7.30 | 6.3 | 2.16 | 71.24 | 27.51 | 2.59 | X | ○ |

As shown in Tables 1 and 2, it is found that the samples with C/B set to less than 2.80 are such that a crack can occur in the insulator due to the repetition of the thermal cycle in the actual engine thermal test. It is conceivable that this is because, as the distance between the boundary portion between the insulator nose length portion and tapered portion and the engine is small, the boundary portion is rapidly cooled when idling, and a large thermal shock is applied to the boundary portion.

Also, it is confirmed that the samples with C/B set to greater than 3.50 are such that an insulator crack can occur when the hot shock test is carried out. It is conceivable that this is because, as the distance between the boundary portion between the insulator nose length portion and tapered portion and the engine is large, the heat of the boundary portion cannot be dissipated to the engine side, and the boundary portion is overheated, thus leading to a decrease in strength of the boundary portion.

As opposed to this, it is revealed that the samples satisfying $2.80 \leq C/B \leq 3.50$, being such that no insulator crack occurs in the two tests, have a superior durability.

It can be said from the results of the two tests that it is preferable that $2.80 \leq C/B \leq 3.50$ is satisfied in order to prevent overheat of the boundary portion between the insulator nose length portion and tapered portion, and to effectively prevent an insulator crack in the boundary portion between the insulator nose length portion and tapered portion by mitigating a thermal shock applied to the boundary portion.

Next, spark plug samples wherein, after the thread diameter of the metal shell is set to M10 or M12, the value of M/A ($g/mm^2$) is made variously different by changing the mass M (g) and area A ($mm^2$), and the angle G (°) is variously changed, are fabricated, and a drop test is carried out on each sample.

The outline of the drop test is as follows. That is, the samples are dropped from a height of 2.5 m in a condition in which they are mounted in a predetermined bush. Subsequently, the insulator of each sample is observed to confirm the presence and absence of a crack in the insulator (particularly, in the boundary portion between the middle barrel portion and increased diameter portion).

Results of the test on samples with the thread diameter set to M10 are shown in Tables 3 to 5, and results of the test on samples with the thread diameter set to M12 are shown in Tables 6 to 8. Sets of ten samples with the same M/A and angle G are prepared, and the drop test is carried out on each sample. Then, it is taken that a set of ten samples is given a "◎" evaluation as being very superior in the crack suppression effect when no insulator crack is found in any of the ten samples, and that a set of ten samples is given a "○" evaluation as having a superior crack suppression effect when an insulator crack is found in one to five samples of the ten samples. Meanwhile, a set of ten samples is given a "Δ" evaluation as being slightly inferior in the crack suppression effect when an insulator crack is found in six to ten samples of the ten samples. Also, an outside diameter D4 of the middle barrel portion and an inside diameter D5 of a region of the axial hole in which the glass seal portions are disposed are shown as reference in Tables 3 to 8. In addition, the opposite side dimension of the tool engagement portion of each sample is set to 14 mm. Furthermore, C/B of the samples with the thread diameter set to M10 is set to 3.38, and C/B of the samples with the thread diameter set to M12 is set to 3.21.

TABLE 3

| Thread Diameter: M10 | | | | | | |
|---|---|---|---|---|---|---|
| Outside Diameter D4 (mm) | Inside Diameter D5 (mm) | Mass M (g) | Cross-sectional Area A ($mm^2$) | M/A ($g/mm^2$) | Angle G (°) | Drop Test |
| 6.25 | 3.00 | 35 | 23.61 | 1.48 | 158 | Δ |
| 6.25 | 3.00 | 35 | 23.61 | 1.48 | 159 | Δ |
| 6.25 | 3.00 | 35 | 23.61 | 1.48 | 160 | Δ |
| 6.25 | 3.00 | 35 | 23.61 | 1.48 | 161 | Δ |
| 6.25 | 3.00 | 35 | 23.61 | 1.48 | 162 | Δ |
| 6.25 | 3.00 | 35 | 23.61 | 1.48 | 163 | ○ |
| 6.25 | 3.00 | 35 | 23.61 | 1.48 | 164 | ○ |
| 6.25 | 3.00 | 35 | 23.61 | 1.48 | 165 | ○ |
| 6.25 | 3.00 | 35 | 23.61 | 1.48 | 166 | ○ |
| 6.25 | 3.00 | 35 | 23.61 | 1.48 | 167 | ○ |
| 6.25 | 2.90 | 35 | 24.07 | 1.45 | 158 | Δ |
| 6.25 | 2.90 | 35 | 24.07 | 1.45 | 159 | Δ |
| 6.25 | 2.90 | 35 | 24.07 | 1.45 | 160 | Δ |
| 6.25 | 2.90 | 35 | 24.07 | 1.45 | 161 | Δ |
| 6.25 | 2.90 | 35 | 24.07 | 1.45 | 162 | Δ |
| 6.25 | 2.90 | 35 | 24.07 | 1.45 | 163 | ○ |
| 6.25 | 2.90 | 35 | 24.07 | 1.45 | 164 | ○ |
| 6.25 | 2.90 | 35 | 24.07 | 1.45 | 165 | ○ |
| 6.25 | 2.90 | 35 | 24.07 | 1.45 | 166 | ○ |
| 6.25 | 2.90 | 35 | 24.07 | 1.45 | 167 | ○ |
| 6.25 | 3.90 | 35 | 18.73 | 1.87 | 163 | ○ |
| 6.25 | 3.60 | 35 | 20.50 | 1.71 | 163 | ○ |
| 6.25 | 3.30 | 35 | 22.13 | 1.58 | 163 | ○ |
| 6.25 | 3.00 | 35 | 23.61 | 1.48 | 163 | ○ |
| 6.25 | 2.90 | 35 | 24.07 | 1.45 | 163 | ○ |
| 6.25 | 2.70 | 35 | 24.95 | 1.40 | 163 | ◎ |
| 6.25 | 2.40 | 35 | 26.16 | 1.34 | 163 | ◎ |
| 6.00 | 2.80 | 35 | 22.12 | 1.58 | 163 | ○ |
| 6.10 | 2.80 | 35 | 23.07 | 1.52 | 163 | ○ |
| 6.20 | 2.80 | 35 | 24.03 | 1.46 | 163 | ○ |
| 6.30 | 2.80 | 35 | 25.01 | 1.40 | 163 | ◎ |
| 6.40 | 2.80 | 35 | 26.01 | 1.35 | 163 | ◎ |
| 6.50 | 2.80 | 35 | 27.03 | 1.30 | 163 | ◎ |
| 6.60 | 2.80 | 35 | 28.05 | 1.25 | 163 | ◎ |

TABLE 4

| Thread Diameter: M10 | | | | | | |
|---|---|---|---|---|---|---|
| Outside Diameter D4 (mm) | Inside Diameter D5 (mm) | Mass M (g) | Cross-sectional Area A ($mm^2$) | M/A ($g/mm^2$) | Angle G (°) | Drop Test |
| 6.25 | 3.00 | 31 | 23.61 | 1.31 | 158 | ○ |
| 6.25 | 3.00 | 31 | 23.61 | 1.31 | 159 | ○ |
| 6.25 | 3.00 | 31 | 23.61 | 1.31 | 160 | ○ |
| 6.25 | 3.00 | 31 | 23.61 | 1.31 | 161 | ○ |
| 6.25 | 3.00 | 31 | 23.61 | 1.31 | 162 | ○ |
| 6.25 | 3.00 | 31 | 23.61 | 1.31 | 163 | ◎ |
| 6.25 | 3.00 | 31 | 23.61 | 1.31 | 164 | ◎ |
| 6.25 | 3.00 | 31 | 23.61 | 1.31 | 165 | ◎ |
| 6.25 | 3.00 | 31 | 23.61 | 1.31 | 166 | ◎ |
| 6.25 | 3.00 | 31 | 23.61 | 1.31 | 167 | ◎ |
| 6.25 | 2.90 | 31 | 24.07 | 1.29 | 158 | ○ |
| 6.25 | 2.90 | 31 | 24.07 | 1.29 | 159 | ○ |
| 6.25 | 2.90 | 31 | 24.07 | 1.29 | 160 | ○ |
| 6.25 | 2.90 | 31 | 24.07 | 1.29 | 161 | ○ |
| 6.25 | 2.90 | 31 | 24.07 | 1.29 | 162 | ○ |
| 6.25 | 2.90 | 31 | 24.07 | 1.29 | 163 | ◎ |
| 6.25 | 2.90 | 31 | 24.07 | 1.29 | 164 | ◎ |
| 6.25 | 2.90 | 31 | 24.07 | 1.29 | 165 | ◎ |
| 6.25 | 2.90 | 31 | 24.07 | 1.29 | 166 | ◎ |
| 6.25 | 2.90 | 31 | 24.07 | 1.29 | 167 | ◎ |
| 6.25 | 3.90 | 31 | 18.73 | 1.65 | 163 | ○ |
| 6.25 | 3.60 | 31 | 20.50 | 1.51 | 163 | ○ |
| 6.25 | 3.30 | 31 | 22.13 | 1.40 | 163 | ◎ |
| 6.25 | 3.00 | 31 | 23.61 | 1.31 | 163 | ◎ |
| 6.25 | 2.90 | 31 | 24.07 | 1.29 | 163 | ◎ |
| 6.25 | 2.70 | 31 | 24.95 | 1.24 | 163 | ◎ |
| 6.25 | 2.40 | 31 | 26.16 | 1.19 | 163 | ◎ |
| 6.00 | 2.80 | 31 | 22.12 | 1.40 | 163 | ◎ |
| 6.10 | 2.80 | 31 | 23.07 | 1.34 | 163 | ◎ |
| 6.20 | 2.80 | 31 | 24.03 | 1.29 | 163 | ◎ |
| 6.30 | 2.80 | 31 | 25.01 | 1.24 | 163 | ◎ |
| 6.40 | 2.80 | 31 | 26.01 | 1.19 | 163 | ◎ |
| 6.50 | 2.80 | 31 | 27.03 | 1.15 | 163 | ◎ |
| 6.60 | 2.80 | 31 | 28.05 | 1.10 | 163 | ◎ |

TABLE 5

| Thread Diameter: M10 | | | | | | |
|---|---|---|---|---|---|---|
| Outside Diameter D4 (mm) | Inside Diameter D5 (mm) | Mass M (g) | Cross-sectional Area A ($mm^2$) | M/A ($g/mm^2$) | Angle G (°) | Drop Test |
| 6.25 | 3.00 | 27 | 23.61 | 1.14 | 158 | ○ |
| 6.25 | 3.00 | 27 | 23.61 | 1.14 | 159 | ○ |
| 6.25 | 3.00 | 27 | 23.61 | 1.14 | 160 | ○ |
| 6.25 | 3.00 | 27 | 23.61 | 1.14 | 161 | ○ |
| 6.25 | 3.00 | 27 | 23.61 | 1.14 | 162 | ○ |
| 6.25 | 3.00 | 27 | 23.61 | 1.14 | 163 | ◎ |
| 6.25 | 3.00 | 27 | 23.61 | 1.14 | 164 | ◎ |
| 6.25 | 3.00 | 27 | 23.61 | 1.14 | 165 | ◎ |
| 6.25 | 3.00 | 27 | 23.61 | 1.14 | 166 | ◎ |
| 6.25 | 3.00 | 27 | 23.61 | 1.14 | 167 | ◎ |
| 6.25 | 2.90 | 27 | 24.07 | 1.12 | 158 | ○ |
| 6.25 | 2.90 | 27 | 24.07 | 1.12 | 159 | ○ |
| 6.25 | 2.90 | 27 | 24.07 | 1.12 | 160 | ○ |
| 6.25 | 2.90 | 27 | 24.07 | 1.12 | 161 | ○ |
| 6.25 | 2.90 | 27 | 24.07 | 1.12 | 162 | ○ |
| 6.25 | 2.90 | 27 | 24.07 | 1.12 | 163 | ◎ |
| 6.25 | 2.90 | 27 | 24.07 | 1.12 | 164 | ◎ |
| 6.25 | 2.90 | 27 | 24.07 | 1.12 | 165 | ◎ |
| 6.25 | 2.90 | 27 | 24.07 | 1.12 | 166 | ◎ |
| 6.25 | 2.90 | 27 | 24.07 | 1.12 | 167 | ◎ |
| 6.25 | 3.90 | 27 | 18.73 | 1.44 | 163 | ○ |
| 6.25 | 3.80 | 27 | 19.34 | 1.40 | 163 | ◎ |
| 6.25 | 3.30 | 27 | 22.13 | 1.22 | 163 | ◎ |
| 6.25 | 3.00 | 27 | 23.61 | 1.14 | 163 | ◎ |
| 6.25 | 2.90 | 27 | 24.07 | 1.12 | 163 | ◎ |
| 6.25 | 2.70 | 27 | 24.95 | 1.08 | 163 | ◎ |

TABLE 5-continued

| Thread Diameter: M10 | | | | | | |
|---|---|---|---|---|---|---|
| Outside Diameter D4 (mm) | Inside Diameter D5 (mm) | Mass M (g) | Cross-sectional Area A ($mm^2$) | M/A ($g/mm^2$) | Angle G (°) | Drop Test |
| 6.25 | 2.40 | 27 | 26.16 | 1.03 | 163 | ◎ |
| 6.00 | 2.80 | 27 | 22.12 | 1.22 | 163 | ◎ |
| 6.10 | 2.80 | 27 | 23.07 | 1.17 | 163 | ◎ |
| 6.20 | 2.80 | 27 | 24.03 | 1.12 | 163 | ◎ |
| 6.30 | 2.80 | 27 | 25.01 | 1.08 | 163 | ◎ |
| 6.40 | 2.80 | 27 | 26.01 | 1.04 | 163 | ◎ |
| 6.50 | 2.80 | 27 | 27.03 | 1.00 | 163 | ◎ |
| 6.60 | 2.80 | 27 | 28.05 | 0.96 | 163 | ◎ |

TABLE 6

| Thread Diameter: M12 | | | | | | |
|---|---|---|---|---|---|---|
| Outside Diameter D4 (mm) | Inside Diameter D5 (mm) | Mass M (g) | Cross-sectional Area A ($mm^2$) | M/A ($g/mm^2$) | Angle G (°) | Drop Test |
| 7.30 | 4.20 | 43 | 28.00 | 1.54 | 159 | Δ |
| 7.30 | 4.20 | 43 | 28.00 | 1.54 | 160 | Δ |
| 7.30 | 4.20 | 43 | 28.00 | 1.54 | 161 | Δ |
| 7.30 | 4.20 | 43 | 28.00 | 1.54 | 162 | Δ |
| 7.30 | 4.20 | 43 | 28.00 | 1.54 | 163 | ○ |
| 7.30 | 4.20 | 43 | 28.00 | 1.54 | 164 | ○ |
| 7.30 | 4.20 | 43 | 28.00 | 1.54 | 165 | ○ |
| 7.30 | 4.20 | 43 | 28.00 | 1.54 | 166 | ○ |
| 7.30 | 4.10 | 43 | 28.65 | 1.50 | 158 | Δ |
| 7.30 | 4.10 | 43 | 28.65 | 1.50 | 159 | Δ |
| 7.30 | 4.10 | 43 | 28.65 | 1.50 | 160 | Δ |
| 7.30 | 4.10 | 43 | 28.65 | 1.50 | 161 | Δ |
| 7.30 | 4.10 | 43 | 28.65 | 1.50 | 162 | Δ |
| 7.30 | 4.10 | 43 | 28.65 | 1.50 | 163 | ○ |
| 7.30 | 4.10 | 43 | 28.65 | 1.50 | 164 | ○ |
| 7.30 | 4.10 | 43 | 28.65 | 1.50 | 165 | ○ |
| 7.30 | 4.10 | 43 | 28.65 | 1.50 | 166 | ○ |
| 7.30 | 4.10 | 43 | 28.65 | 1.50 | 167 | ○ |
| 7.30 | 3.00 | 43 | 34.79 | 1.24 | 158 | ○ |
| 7.30 | 3.00 | 43 | 34.79 | 1.24 | 159 | ○ |
| 7.30 | 3.00 | 43 | 34.79 | 1.24 | 160 | ○ |
| 7.30 | 3.00 | 43 | 34.79 | 1.24 | 161 | ○ |
| 7.30 | 3.00 | 43 | 34.79 | 1.24 | 162 | ○ |
| 7.30 | 3.00 | 43 | 34.79 | 1.24 | 163 | ◎ |
| 7.30 | 3.00 | 43 | 34.79 | 1.24 | 164 | ◎ |
| 7.30 | 3.00 | 43 | 34.79 | 1.24 | 165 | ◎ |
| 7.30 | 3.00 | 43 | 34.79 | 1.24 | 166 | ◎ |
| 7.30 | 3.00 | 43 | 34.79 | 1.24 | 167 | ◎ |
| 7.30 | 4.20 | 43 | 28.00 | 1.54 | 163 | ○ |
| 7.30 | 4.00 | 43 | 29.29 | 1.47 | 163 | ○ |
| 7.30 | 3.75 | 43 | 30.81 | 1.40 | 163 | ◎ |
| 7.30 | 3.60 | 43 | 31.68 | 1.36 | 163 | ◎ |
| 7.30 | 3.40 | 43 | 32.77 | 1.31 | 163 | ◎ |
| 7.30 | 3.20 | 43 | 33.81 | 1.27 | 163 | ◎ |
| 7.30 | 3.00 | 43 | 34.79 | 1.24 | 163 | ◎ |
| 7.30 | 2.80 | 43 | 35.70 | 1.20 | 163 | ◎ |
| 7.50 | 4.60 | 43 | 27.56 | 1.56 | 163 | ○ |
| 7.50 | 4.50 | 43 | 28.27 | 1.52 | 163 | ○ |
| 7.50 | 4.40 | 43 | 28.97 | 1.48 | 163 | ○ |
| 7.50 | 4.30 | 43 | 29.66 | 1.45 | 163 | ○ |
| 7.50 | 4.20 | 43 | 30.32 | 1.42 | 163 | ○ |
| 7.50 | 4.10 | 43 | 30.98 | 1.39 | 163 | ◎ |

TABLE 7

| Thread Diameter: M12 | | | | | | |
|---|---|---|---|---|---|---|
| Outside Diameter D4 (mm) | Inside Diameter D5 (mm) | Mass M (g) | Cross-sectional Area A ($mm^2$) | M/A ($g/mm^2$) | Angle G (°) | Drop Test |
| 7.30 | 4.20 | 40 | 28.00 | 1.43 | 159 | Δ |
| 7.30 | 4.20 | 40 | 28.00 | 1.43 | 160 | Δ |
| 7.30 | 4.20 | 40 | 28.00 | 1.43 | 161 | Δ |
| 7.30 | 4.20 | 40 | 28.00 | 1.43 | 162 | Δ |
| 7.30 | 4.20 | 40 | 28.00 | 1.43 | 163 | ○ |
| 7.30 | 4.20 | 40 | 28.00 | 1.43 | 164 | ○ |
| 7.30 | 4.20 | 40 | 28.00 | 1.43 | 165 | ○ |
| 7.30 | 4.20 | 40 | 28.00 | 1.43 | 166 | ○ |
| 7.30 | 4.10 | 40 | 28.65 | 1.40 | 158 | ○ |
| 7.30 | 4.10 | 40 | 28.65 | 1.40 | 159 | ○ |
| 7.30 | 4.10 | 40 | 28.65 | 1.40 | 160 | ○ |
| 7.30 | 4.10 | 40 | 28.65 | 1.40 | 161 | ○ |
| 7.30 | 4.10 | 40 | 28.65 | 1.40 | 162 | ○ |
| 7.30 | 4.10 | 40 | 28.65 | 1.40 | 163 | ◎ |
| 7.30 | 4.10 | 40 | 28.65 | 1.40 | 164 | ◎ |
| 7.30 | 4.10 | 40 | 28.65 | 1.40 | 165 | ◎ |
| 7.30 | 4.10 | 40 | 28.65 | 1.40 | 166 | ◎ |
| 7.30 | 4.10 | 40 | 28.65 | 1.40 | 167 | ◎ |
| 7.30 | 3.00 | 40 | 34.79 | 1.15 | 158 | ○ |
| 7.30 | 3.00 | 40 | 34.79 | 1.15 | 159 | ○ |
| 7.30 | 3.00 | 40 | 34.79 | 1.15 | 160 | ○ |
| 7.30 | 3.00 | 40 | 34.79 | 1.15 | 161 | ○ |
| 7.30 | 3.00 | 40 | 34.79 | 1.15 | 162 | ○ |
| 7.30 | 3.00 | 40 | 34.79 | 1.15 | 163 | ◎ |
| 7.30 | 3.00 | 40 | 34.79 | 1.15 | 164 | ◎ |
| 7.30 | 3.00 | 40 | 34.79 | 1.15 | 165 | ◎ |
| 7.30 | 3.00 | 40 | 34.79 | 1.15 | 166 | ◎ |
| 7.30 | 3.00 | 40 | 34.79 | 1.15 | 167 | ◎ |
| 7.30 | 4.20 | 40 | 28.00 | 1.43 | 163 | ○ |
| 7.30 | 4.00 | 40 | 29.29 | 1.37 | 163 | ◎ |
| 7.30 | 3.80 | 40 | 30.51 | 1.31 | 163 | ◎ |
| 7.30 | 3.60 | 40 | 31.68 | 1.26 | 163 | ◎ |
| 7.30 | 3.40 | 40 | 32.77 | 1.22 | 163 | ◎ |
| 7.30 | 3.20 | 40 | 33.81 | 1.18 | 163 | ◎ |
| 7.30 | 3.00 | 40 | 34.79 | 1.15 | 163 | ◎ |
| 7.30 | 2.80 | 40 | 35.70 | 1.12 | 163 | ◎ |
| 7.50 | 4.60 | 40 | 27.56 | 1.45 | 163 | ○ |
| 7.50 | 4.50 | 40 | 28.27 | 1.41 | 163 | ○ |
| 7.50 | 4.40 | 40 | 28.97 | 1.38 | 163 | ◎ |
| 7.50 | 4.30 | 40 | 29.66 | 1.35 | 163 | ◎ |
| 7.50 | 4.20 | 40 | 30.32 | 1.32 | 163 | ◎ |
| 7.50 | 4.10 | 40 | 30.98 | 1.29 | 163 | ◎ |

TABLE 8

| Thread Diameter: M12 | | | | | | |
|---|---|---|---|---|---|---|
| Outside Diameter D4 (mm) | Inside Diameter D5 (mm) | Mass M (g) | Cross-sectional Area A ($mm^2$) | M/A ($g/mm^2$) | Angle G (°) | Drop Test |
| 7.30 | 4.50 | 37 | 25.95 | 1.43 | 159 | Δ |
| 7.30 | 4.50 | 37 | 25.95 | 1.43 | 160 | Δ |
| 7.30 | 4.50 | 37 | 25.95 | 1.43 | 161 | Δ |
| 7.30 | 4.50 | 37 | 25.95 | 1.43 | 162 | Δ |
| 7.30 | 4.50 | 37 | 25.95 | 1.43 | 163 | ○ |
| 7.30 | 4.50 | 37 | 25.95 | 1.43 | 164 | ○ |
| 7.30 | 4.50 | 37 | 25.95 | 1.43 | 165 | ○ |
| 7.30 | 4.50 | 37 | 25.95 | 1.43 | 166 | ○ |
| 7.30 | 4.10 | 37 | 28.65 | 1.29 | 158 | ○ |
| 7.30 | 4.10 | 37 | 28.65 | 1.29 | 159 | ○ |
| 7.30 | 4.10 | 37 | 28.65 | 1.29 | 160 | ○ |
| 7.30 | 4.10 | 37 | 28.65 | 1.29 | 161 | ○ |
| 7.30 | 4.10 | 37 | 28.65 | 1.29 | 162 | ○ |
| 7.30 | 4.10 | 37 | 28.65 | 1.29 | 163 | ◎ |
| 7.30 | 4.10 | 37 | 28.65 | 1.29 | 164 | ◎ |
| 7.30 | 4.10 | 37 | 28.65 | 1.29 | 165 | ◎ |
| 7.30 | 4.10 | 37 | 28.65 | 1.29 | 166 | ◎ |
| 7.30 | 4.10 | 37 | 28.65 | 1.29 | 167 | ◎ |

TABLE 8-continued

| Thread Diameter: M12 | | | | | | |
|---|---|---|---|---|---|---|
| Outside Diameter D4 (mm) | Inside Diameter D5 (mm) | Mass M (g) | Cross-sectional Area A ($mm^2$) | M/A ($g/mm^2$) | Angle G (°) | Drop Test |
| 7.30 | 3.00 | 37 | 34.79 | 1.06 | 158 | ○ |
| 7.30 | 3.00 | 37 | 34.79 | 1.06 | 159 | ○ |
| 7.30 | 3.00 | 37 | 34.79 | 1.06 | 160 | ○ |
| 7.30 | 3.00 | 37 | 34.79 | 1.06 | 161 | ○ |
| 7.30 | 3.00 | 37 | 34.79 | 1.06 | 162 | ○ |
| 7.30 | 3.00 | 37 | 34.79 | 1.06 | 163 | ◎ |
| 7.30 | 3.00 | 37 | 34.79 | 1.06 | 164 | ◎ |
| 7.30 | 3.00 | 37 | 34.79 | 1.06 | 165 | ◎ |
| 7.30 | 3.00 | 37 | 34.79 | 1.06 | 166 | ◎ |
| 7.30 | 3.00 | 37 | 34.79 | 1.06 | 167 | ◎ |
| 7.30 | 4.20 | 37 | 28.00 | 1.32 | 163 | ◎ |
| 7.30 | 4.00 | 37 | 29.29 | 1.26 | 163 | ◎ |
| 7.30 | 3.80 | 37 | 30.51 | 1.21 | 163 | ◎ |
| 7.30 | 3.60 | 37 | 31.68 | 1.17 | 163 | ◎ |
| 7.30 | 3.40 | 37 | 32.77 | 1.13 | 163 | ◎ |
| 7.30 | 3.20 | 37 | 33.81 | 1.09 | 163 | ◎ |
| 7.30 | 3.00 | 37 | 34.79 | 1.06 | 163 | ◎ |
| 7.30 | 2.80 | 37 | 35.70 | 1.04 | 163 | ◎ |
| 7.50 | 4.75 | 37 | 26.46 | 1.40 | 163 | ◎ |
| 7.50 | 4.50 | 37 | 28.27 | 1.31 | 163 | ◎ |
| 7.50 | 4.40 | 37 | 28.97 | 1.28 | 163 | ◎ |
| 7.50 | 4.30 | 37 | 29.66 | 1.25 | 163 | ◎ |
| 7.50 | 4.20 | 37 | 30.32 | 1.22 | 163 | ◎ |
| 7.50 | 4.10 | 37 | 30.98 | 1.19 | 163 | ◎ |

As shown in Tables 3 to 8, it is found that the samples satisfying M/A≤1.40 are superior in the effect of suppressing an insulator crack in the boundary portion between the middle barrel portion and increased diameter portion. It is conceivable that this is because, as the cross-sectional area A appropriate to the mechanical strength of the boundary portion between the middle barrel portion and increased diameter portion is made large enough with respect to the mass M of the spark plug appropriate to stress applied to the boundary portion when dropping, the boundary portion can sufficiently resist the stress.

Furthermore, it is revealed that the samples satisfying G≥163° are also superior in the insulator crack suppression effect. It is conceivable that this is because stress applied to the boundary portion when dropping is dispersed by adopting a configuration such that the outside diameter of the region from the middle barrel portion to the increased diameter portion changes gradually.

Also, it is confirmed that particularly the samples satisfying both M/A≤1.40 and G≥163° have a very superior crack suppression effect.

It can be said from the test results that it is preferable that M/A≤1.40 or G≥163° is satisfied, and it is still more preferable that both M/A≤1.40 and G≥163° are satisfied, from the standpoint of more effectively preventing an insulator crack in the boundary portion between the middle barrel portion and increased diameter portion, and thus realizing a more superior durability.

Next, spark plug samples wherein, after the thread diameter of the metal shell is set to M10 or M12, the value of (M/B)·K (g/mm) is made variously different by changing the mass M (g), the cross-sectional area B ($mm^2$), and the length K (mm) of the insulator nose length portion, are fabricated, and the heretofore described drop test wherein the drop distance is changed from 2.5 m to 3.0 m is carried out on each sample. The presence or absence of a crack in the boundary portion between the insulator nose length portion and tapered portion is confirmed in the drop test.

Results of the test on the samples with the thread diameter set to M10 are shown in Tables 9 to 11, and results of the test on the samples with the thread diameter set to M12 are shown in Tables 12 to 14. Sets of ten samples with the same (M/B)·K are prepared, and the drop test is carried out on each sample. Then, it is taken that a set of ten samples is given a "○" evaluation as being very superior in the crack suppression effect when no insulator crack is found in any of the ten samples, while a set of ten samples is given a "Δ" evaluation in that a crack is likely to occur when an insulator crack is found in at least one of the ten samples. Also, the inside diameter D1, outside diameter D2, opening diameter D3, cross-sectional area C, and C/B are shown as reference in Tables 9 to 14. In addition, in each sample, the opposite side dimension of the tool engagement portion is set to 14 mm, the angle G is set to 163°, and M/A≤1.40 is set.

TABLE 9

| Thread Diameter: M10 | | | | | | | | | |
|---|---|---|---|---|---|---|---|---|---|
| Inside Diameter D1 (mm) | Outside Diameter D2 (mm) | Opening Diameter D3 (mm) | Mass M (g) | Cross-sectional Area C ($mm^2$) | Cross-sectional Area B ($mm^2$) | C/B | Insulator Nose Length K | M/(B/K) | Drop Test |
| 5.50 | 4.7 | 2.16 | 35 | 54.78 | 13.69 | 4.0 | 9.00 | 23.0 | ○ |
| 5.50 | 4.7 | 2.16 | 35 | 54.78 | 13.69 | 4.0 | 12.00 | 30.7 | Δ |
| 5.50 | 4.7 | 2.16 | 35 | 54.78 | 13.69 | 4.0 | 13.00 | 33.2 | Δ |
| 5.50 | 4.7 | 2.16 | 35 | 54.78 | 13.69 | 4.0 | 14.00 | 35.8 | Δ |
| 5.50 | 4.7 | 2.16 | 35 | 54.78 | 13.69 | 4.0 | 15.00 | 38.4 | Δ |
| 5.50 | 4.7 | 2.16 | 35 | 54.78 | 13.69 | 4.0 | 16.00 | 40.9 | Δ |
| 5.50 | 4.7 | 2.16 | 35 | 54.78 | 13.69 | 4.0 | 17.00 | 43.5 | Δ |
| 5.50 | 4.7 | 2.16 | 35 | 54.78 | 13.69 | 4.0 | 18.00 | 46.0 | Δ |
| 5.70 | 5.0 | 1.96 | 35 | 53.02 | 16.62 | 3.19 | 10.00 | 21.1 | ○ |
| 5.70 | 5.0 | 1.96 | 35 | 53.02 | 16.62 | 3.19 | 11.00 | 23.2 | ○ |
| 5.70 | 5.0 | 1.96 | 35 | 53.02 | 16.62 | 3.19 | 12.00 | 25.3 | Δ |
| 5.70 | 5.0 | 1.96 | 35 | 53.02 | 16.62 | 3.19 | 13.00 | 27.4 | Δ |
| 5.70 | 5.0 | 1.96 | 35 | 53.02 | 16.62 | 3.19 | 14.00 | 29.5 | Δ |
| 5.70 | 5.0 | 1.96 | 35 | 53.02 | 16.62 | 3.19 | 15.00 | 31.6 | Δ |
| 5.70 | 5.0 | 1.96 | 35 | 53.02 | 16.62 | 3.19 | 16.00 | 33.7 | Δ |
| 5.70 | 5.2 | 1.76 | 35 | 53.02 | 18.80 | 2.82 | 11.00 | 20.5 | ○ |
| 5.70 | 5.2 | 1.76 | 35 | 53.02 | 18.80 | 2.82 | 12.00 | 22.3 | ○ |
| 5.70 | 5.2 | 1.76 | 35 | 53.02 | 18.80 | 2.82 | 13.00 | 24.2 | ○ |
| 5.70 | 5.2 | 1.76 | 35 | 53.02 | 18.80 | 2.82 | 13.45 | 25.0 | ○ |
| 5.70 | 5.2 | 1.76 | 35 | 53.02 | 18.80 | 2.82 | 14.00 | 26.1 | Δ |
| 5.70 | 5.2 | 1.76 | 35 | 53.02 | 18.80 | 2.82 | 15.00 | 27.9 | Δ |
| 5.70 | 5.2 | 1.76 | 35 | 53.02 | 18.80 | 2.82 | 16.00 | 29.8 | Δ |

TABLE 10

| Thread Diameter: M10 | | | | | | | | | |
|---|---|---|---|---|---|---|---|---|---|
| Inside Diameter D1 (mm) | Outside Diameter D2 (mm) | Opening Diameter D3 (mm) | Mass M (g) | Cross-sectional Area C ($mm^2$) | Cross-sectional Area B ($mm^2$) | C/B | Insulator Nose Length K | M/(B/K) | Drop Test |
| 5.50 | 4.7 | 2.16 | 31 | 54.78 | 13.69 | 4.00 | 10.00 | 22.7 | ○ |
| 5.50 | 4.7 | 2.16 | 31 | 54.78 | 13.69 | 4.00 | 11.00 | 24.9 | ○ |
| 5.50 | 4.7 | 2.16 | 31 | 54.78 | 13.69 | 4.00 | 12.00 | 27.2 | Δ |
| 5.50 | 4.7 | 2.16 | 31 | 54.78 | 13.69 | 4.00 | 13.00 | 29.4 | Δ |
| 5.50 | 4.7 | 2.16 | 31 | 54.78 | 13.69 | 4.00 | 14.00 | 31.7 | Δ |
| 5.50 | 4.7 | 2.16 | 31 | 54.78 | 13.69 | 4.00 | 15.00 | 34.0 | Δ |
| 5.50 | 4.7 | 2.16 | 31 | 54.78 | 13.69 | 4.00 | 16.00 | 36.2 | Δ |
| 5.50 | 4.7 | 2.16 | 31 | 54.78 | 13.69 | 4.00 | 17.00 | 38.5 | Δ |
| 5.70 | 5.0 | 1.96 | 31 | 53.02 | 16.62 | 3.19 | 11.00 | 20.5 | ○ |
| 5.70 | 5.0 | 1.96 | 31 | 53.02 | 16.62 | 3.19 | 12.00 | 22.4 | ○ |
| 5.70 | 5.0 | 1.96 | 31 | 53.02 | 16.62 | 3.19 | 13.00 | 24.3 | ○ |
| 5.70 | 5.0 | 1.96 | 31 | 53.02 | 16.62 | 3.19 | 13.40 | 25.0 | ○ |
| 5.70 | 5.0 | 1.96 | 31 | 53.02 | 16.62 | 3.19 | 15.00 | 28.0 | Δ |
| 5.70 | 5.0 | 1.96 | 31 | 53.02 | 16.62 | 3.19 | 16.00 | 29.8 | Δ |
| 5.70 | 5.0 | 1.96 | 31 | 53.02 | 16.62 | 3.19 | 17.00 | 31.7 | Δ |
| 5.70 | 5.2 | 1.76 | 31 | 53.02 | 18.80 | 2.82 | 12.00 | 19.8 | ○ |
| 5.70 | 5.2 | 1.76 | 31 | 53.02 | 18.80 | 2.82 | 13.00 | 21.4 | ○ |
| 5.70 | 5.2 | 1.76 | 31 | 53.02 | 18.80 | 2.82 | 14.00 | 23.1 | ○ |
| 5.70 | 5.2 | 1.76 | 31 | 53.02 | 18.80 | 2.82 | 15.00 | 24.7 | ○ |
| 5.70 | 5.2 | 1.76 | 31 | 53.02 | 18.80 | 2.82 | 15.10 | 24.9 | ○ |
| 5.70 | 5.2 | 1.76 | 31 | 53.02 | 18.80 | 2.82 | 16.00 | 26.4 | Δ |
| 5.70 | 5.2 | 1.76 | 31 | 53.02 | 18.80 | 2.82 | 17.00 | 28.0 | Δ |

TABLE 11

| Thread Diameter: M10 | | | | | | | | | |
|---|---|---|---|---|---|---|---|---|---|
| Inside Diameter D1 (mm) | Outside Diameter D2 (mm) | Opening Diameter D3 (mm) | Mass M (g) | Cross-sectional Area C ($mm^2$) | Cross-sectional Area B ($mm^2$) | C/B | Insulator Nose Length K | M/(B/K) | Drop Test |
| 5.50 | 4.7 | 2.16 | 27 | 54.78 | 13.69 | 4.00 | 10.00 | 19.7 | ○ |
| 5.50 | 4.7 | 2.16 | 27 | 54.78 | 13.69 | 4.00 | 11.00 | 21.7 | ○ |
| 5.50 | 4.7 | 2.16 | 27 | 54.78 | 13.69 | 4.00 | 12.00 | 23.7 | ○ |
| 5.50 | 4.7 | 2.16 | 27 | 54.78 | 13.69 | 4.00 | 13.00 | 25.6 | Δ |
| 5.50 | 4.7 | 2.16 | 27 | 54.78 | 13.69 | 4.00 | 14.00 | 27.6 | Δ |
| 5.50 | 4.7 | 2.16 | 27 | 54.78 | 13.69 | 4.00 | 15.00 | 29.6 | Δ |
| 5.50 | 4.7 | 2.16 | 27 | 54.78 | 13.69 | 4.00 | 16.00 | 31.6 | Δ |
| 5.50 | 4.7 | 2.16 | 27 | 54.78 | 13.69 | 4.00 | 17.00 | 33.5 | Δ |
| 5.70 | 5.2 | 1.96 | 27 | 53.02 | 18.22 | 2.91 | 12.00 | 17.8 | ○ |
| 5.70 | 5.2 | 1.96 | 27 | 53.02 | 18.22 | 2.91 | 13.00 | 19.3 | ○ |
| 5.70 | 5.2 | 1.96 | 27 | 53.02 | 18.22 | 2.91 | 14.00 | 20.7 | ○ |
| 5.70 | 5.2 | 1.96 | 27 | 53.02 | 18.22 | 2.91 | 15.00 | 22.2 | ○ |
| 5.70 | 5.2 | 1.96 | 27 | 53.02 | 18.22 | 2.91 | 16.00 | 23.7 | ○ |
| 5.70 | 5.2 | 1.96 | 27 | 53.02 | 18.22 | 2.91 | 17.00 | 25.2 | Δ |
| 5.70 | 5.2 | 1.96 | 27 | 53.02 | 18.22 | 2.91 | 18.00 | 26.7 | Δ |
| 5.70 | 5.2 | 1.76 | 27 | 53.02 | 18.80 | 2.82 | 12.00 | 17.2 | ○ |
| 5.70 | 5.2 | 1.76 | 27 | 53.02 | 18.80 | 2.82 | 13.00 | 18.7 | ○ |
| 5.70 | 5.2 | 1.76 | 27 | 53.02 | 18.80 | 2.82 | 14.00 | 20.1 | ○ |
| 5.70 | 5.2 | 1.76 | 27 | 53.02 | 18.80 | 2.82 | 15.00 | 21.5 | ○ |
| 5.70 | 5.2 | 1.76 | 27 | 53.02 | 18.80 | 2.82 | 16.00 | 23.0 | ○ |
| 5.70 | 5.2 | 1.76 | 27 | 53.02 | 18.80 | 2.82 | 17.40 | 25.0 | ○ |
| 5.70 | 5.2 | 1.76 | 27 | 53.02 | 18.80 | 2.82 | 18.00 | 25.8 | Δ |

TABLE 12

| Thread Diameter: M12 | | | | | | | | | |
|---|---|---|---|---|---|---|---|---|---|
| Inside Diameter D1 (mm) | Outside Diameter D2 (mm) | Opening Diameter D3 (mm) | Mass M (g) | Cross-sectional Area C ($mm^2$) | Cross-sectional Area B ($mm^2$) | C/B | Insulator Nose Length K | M/(B/K) | Drop Test |
| 6.60 | 5.7 | 2.36 | 43 | 78.89 | 21.14 | 3.73 | 10.00 | 20.3 | ○ |
| 6.60 | 5.7 | 2.36 | 43 | 78.89 | 21.14 | 3.73 | 11.00 | 22.4 | ○ |
| 6.60 | 5.7 | 2.36 | 43 | 78.89 | 21.14 | 3.73 | 12.00 | 24.4 | ○ |
| 6.60 | 5.7 | 2.36 | 43 | 78.89 | 21.14 | 3.73 | 12.30 | 25.0 | ○ |
| 6.60 | 5.7 | 2.36 | 43 | 78.89 | 21.14 | 3.73 | 14.00 | 28.5 | Δ |
| 6.60 | 5.7 | 2.36 | 43 | 78.89 | 21.14 | 3.73 | 15.00 | 30.5 | Δ |
| 6.60 | 5.7 | 2.36 | 43 | 78.89 | 21.14 | 3.73 | 16.00 | 32.5 | Δ |
| 6.60 | 5.7 | 2.36 | 43 | 78.89 | 21.14 | 3.73 | 17.00 | 34.6 | Δ |
| 6.60 | 6.1 | 2.16 | 43 | 78.89 | 25.56 | 3.09 | 10.00 | 16.8 | ○ |
| 6.60 | 6.1 | 2.16 | 43 | 78.89 | 25.56 | 3.09 | 12.00 | 20.2 | ○ |
| 6.60 | 6.1 | 2.16 | 43 | 78.89 | 25.56 | 3.09 | 14.00 | 23.6 | ○ |
| 6.60 | 6.1 | 2.16 | 43 | 78.89 | 25.56 | 3.09 | 15.00 | 25.2 | Δ |
| 6.60 | 6.1 | 2.16 | 43 | 78.89 | 25.56 | 3.09 | 16.00 | 26.9 | Δ |
| 6 60 | 6.1 | 2.16 | 43 | 78.89 | 25.56 | 3.09 | 17.00 | 28.6 | Δ |
| 6.60 | 6.1 | 2.16 | 43 | 78.89 | 25.56 | 3.09 | 18.00 | 30.3 | Δ |
| 6.60 | 6.2 | 2.16 | 43 | 78.89 | 26.53 | 2.97 | 10.00 | 16.2 | ○ |
| 6.60 | 6.2 | 2.16 | 43 | 78.89 | 26.53 | 2.97 | 12.00 | 19.5 | ○ |
| 6.60 | 6.2 | 2.16 | 43 | 78.89 | 26.53 | 2.97 | 14.00 | 22.7 | ○ |
| 6.60 | 6.2 | 2.16 | 43 | 78.89 | 26.53 | 2.97 | 15.00 | 24.3 | ○ |
| 6.60 | 6.2 | 2.16 | 43 | 78.89 | 26.53 | 2.97 | 16.00 | 25.9 | Δ |
| 6.60 | 6.2 | 2.16 | 43 | 78.89 | 26.53 | 2.97 | 17.00 | 27.6 | Δ |
| 6.60 | 6.2 | 2.16 | 43 | 78.89 | 26.53 | 2.97 | 18.00 | 29.2 | Δ |

TABLE 13

| Thread Diameter: M12 | | | | | | | | | |
|---|---|---|---|---|---|---|---|---|---|
| Inside Diameter D1 (mm) | Outside Diameter D2 (mm) | Opening Diameter D3 (mm) | Mass M (g) | Cross-sectional Area C ($mm^2$) | Cross-sectional Area B ($mm^2$) | C/B | Insulator Nose Length K | M/(B/K) | Drop Test |
| 6.60 | 5.7 | 2.36 | 40 | 78.89 | 21.14 | 3.73 | 10.00 | 18.9 | ○ |
| 6.60 | 5.7 | 2.36 | 40 | 78.89 | 21.14 | 3.73 | 11.00 | 20.8 | ○ |
| 6.60 | 5.7 | 2.36 | 40 | 78.89 | 21.14 | 3.73 | 12.00 | 22.7 | ○ |
| 6.60 | 5.7 | 2.36 | 40 | 78.89 | 21.14 | 3.73 | 13.20 | 25.0 | ○ |

TABLE 13-continued

| Thread Diameter: M12 | | | | | | | | | |
|---|---|---|---|---|---|---|---|---|---|
| Inside Diameter D1 (mm) | Outside Diameter D2 (mm) | Opening Diameter D3 (mm) | Mass M (g) | Cross-sectional Area C ($mm^2$) | Cross-sectional Area B ($mm^2$) | C/B | Insulator Nose Length K | M/(B/K) | Drop Test |
| 6.60 | 5.7 | 2.36 | 40 | 78.89 | 21.14 | 3.73 | 14.00 | 26.5 | Δ |
| 6.60 | 5.7 | 2.36 | 40 | 78.89 | 21.14 | 3.73 | 15.00 | 28.4 | Δ |
| 6.60 | 5.7 | 2.36 | 40 | 78.89 | 21.14 | 3.73 | 16.00 | 30.3 | Δ |
| 6.60 | 5.7 | 2.36 | 40 | 78.89 | 21.14 | 3.73 | 17.00 | 32.2 | Δ |
| 6.60 | 6.0 | 2.16 | 40 | 78.89 | 24.61 | 3.21 | 10.00 | 16.3 | ○ |
| 6.60 | 6.0 | 2.16 | 40 | 78.89 | 24.61 | 3.21 | 12.00 | 19.5 | ○ |
| 6.60 | 6.0 | 2.16 | 40 | 78.89 | 24.61 | 3.21 | 14.00 | 22.8 | ○ |
| 6.60 | 6.0 | 2.16 | 40 | 78.89 | 24.61 | 3.21 | 15.00 | 24.4 | ○ |
| 6.60 | 6.0 | 2.16 | 40 | 78.89 | 24.61 | 3.21 | 16.00 | 26.0 | Δ |
| 6.60 | 6.0 | 2.16 | 40 | 78.89 | 24.61 | 3.21 | 17.00 | 27.6 | Δ |
| 6.60 | 6.0 | 2.16 | 40 | 78.89 | 24.61 | 3.21 | 18.00 | 29.3 | Δ |
| 6.60 | 6.2 | 2.16 | 40 | 78.89 | 26.53 | 2.97 | 10.00 | 15.1 | ○ |
| 6.60 | 6.2 | 2.16 | 40 | 78.89 | 26.53 | 2.97 | 12.00 | 18.1 | ○ |
| 6.60 | 6.2 | 2.16 | 40 | 78.89 | 26.53 | 2.97 | 14.00 | 21.1 | ○ |
| 6.60 | 6.2 | 2.16 | 40 | 78.89 | 26.53 | 2.97 | 15.00 | 22.6 | ○ |
| 6.60 | 6.2 | 2.16 | 40 | 78.89 | 26.53 | 2.97 | 16.00 | 24.1 | ○ |
| 6.60 | 6.2 | 2.16 | 40 | 78.89 | 26.53 | 2.97 | 17.00 | 25.6 | Δ |
| 6.60 | 6.2 | 2.16 | 40 | 78.89 | 26.53 | 2.97 | 18.00 | 27.1 | Δ |

TABLE 14

| Thread Diameter: M12 | | | | | | | | | |
|---|---|---|---|---|---|---|---|---|---|
| Inside Diameter D1 (mm) | Outside Diameter D2 (mm) | Opening Diameter D3 (mm) | Mass M (g) | Cross-sectional Area C ($mm^2$) | Cross-sectional Area B ($mm^2$) | C/B | Insulator Nose Length K | M/(B/K) | Drop Test |
| 6.60 | 5.7 | 2.36 | 37 | 78.89 | 21.14 | 3.73 | 10.00 | 17.5 | ○ |
| 6.60 | 5.7 | 2.36 | 37 | 78.89 | 21.14 | 3.73 | 11.00 | 19.2 | ○ |
| 6.60 | 5.7 | 2.36 | 37 | 78.89 | 21.14 | 3.73 | 12.00 | 21.0 | ○ |
| 6.60 | 5.7 | 2.36 | 37 | 78.89 | 21.14 | 3.73 | 13.00 | 22.7 | ○ |
| 6.60 | 5.7 | 2.36 | 37 | 78.89 | 21.14 | 3.73 | 14.30 | 25.0 | ○ |
| 6.60 | 5.7 | 2.36 | 37 | 78.89 | 21.14 | 3.73 | 15.00 | 26.2 | Δ |
| 6.60 | 5.7 | 2.36 | 37 | 78.89 | 21.14 | 3.73 | 16.00 | 28.0 | Δ |
| 6.60 | 5.7 | 2.36 | 37 | 78.89 | 21.14 | 3.73 | 17.00 | 29.7 | Δ |
| 6.60 | 6.0 | 2.16 | 37 | 78.89 | 24.61 | 3.21 | 10.00 | 15.0 | ○ |
| 6.60 | 6.0 | 2.16 | 37 | 78.89 | 24.61 | 3.21 | 12.00 | 18.0 | ○ |
| 6.60 | 6.0 | 2.16 | 37 | 78.89 | 24.61 | 3.21 | 14.00 | 21.0 | ○ |
| 6.60 | 6.0 | 2.16 | 37 | 78.89 | 24.61 | 3.21 | 15.00 | 22.6 | ○ |
| 6.60 | 6.0 | 2.16 | 37 | 78.89 | 24.61 | 3.21 | 16.00 | 24.1 | ○ |
| 6.60 | 6.0 | 2.16 | 37 | 78.89 | 24.61 | 3.21 | 17.00 | 25.6 | Δ |
| 6.60 | 6.0 | 2.16 | 37 | 78.89 | 24.61 | 3.21 | 18.00 | 27.1 | Δ |
| 6.60 | 6.2 | 2.16 | 37 | 78.89 | 26.53 | 2.97 | 10.00 | 13.9 | ○ |
| 6.60 | 6.2 | 2.16 | 37 | 78.89 | 26.53 | 2.97 | 12.00 | 16.7 | ○ |
| 6.60 | 6.2 | 2.16 | 37 | 78.89 | 26.53 | 2.97 | 14.00 | 19.5 | ○ |
| 6.60 | 6.2 | 2.16 | 37 | 78.89 | 26.53 | 2.97 | 15.00 | 20.9 | ○ |
| 6.60 | 6.2 | 2.16 | 37 | 78.89 | 26.53 | 2.97 | 16.00 | 22.3 | ○ |
| 6.60 | 6.2 | 2.16 | 37 | 78.89 | 26.53 | 2.97 | 17.00 | 23.7 | ○ |
| 6.60 | 6.2 | 2.16 | 37 | 78.89 | 26.53 | 2.97 | 18.00 | 25.1 | Δ |

As shown in Tables 9 to 14, it is found that the samples satisfying $(M/B)\cdot K \leq 25.0$ are such that it is possible to effectively suppress an insulator crack in the boundary portion between the insulator nose length portion and tapered portion despite the fact that the samples have been dropped from a height of 3.0 m and a larger shock has been applied to them. It is conceivable that this is because, by the cross-sectional area B appropriate to the mechanical strength of the boundary portion being made large enough, the boundary portion is provided with strength high enough to resist stress corresponding to the product of the mass M and length K.

It can be said from the test results that it is more preferable to adopt a configuration such that $(M/B)\cdot K \leq 25.0$ is satisfied in order to more effectively prevent an insulator crack in the boundary portion between the insulator nose length portion and tapered portion, and thus realize a more superior durability.

Next, spark plug samples wherein the forward end portion of the insulator in the axis direction is taken to be a + side, while the rear end portion of the insulator is taken to be a − side, with the boundary between the middle barrel portion and increased diameter portion as a reference, and a distance X (mm) from the boundary to the rear end of the glass seal portions is made variously different by changing a disposition position of the glass seal portions in the axial hole, are fabricated, and a bending test is carried out on each sample.

The outline of the bending test is as follows. That is, after the spark plugs are fixed to a predetermined test bed, a load is applied to a rear end portion of the insulator based on the insulator bending strength test stipulated by JIS B8031, thus measuring a load (a breaking load) when an insulator crack occurs in the boundary portion between the middle barrel portion and increased diameter portion.

Results of the test are shown in Table 15. The thread diameter of the samples is set to M10 or M12. C/B of samples with the thread diameter set to M10 is set to 3.33, and C/B of samples with the thread diameter set to M12 is set to 3.21. Also, each sample is configured in such a way as to satisfy M/A≤1.40 and (M/B)·K≤25.0.

TABLE 15

| Thread Diameter | Distance X (mm) | Breaking Load (N) |
|---|---|---|
| M10 | −0.5 | 1110 |
| | −0.3 | 1120 |
| | 0.0 | 1090 |
| | 0.3 | 1200 |
| | 0.5 | 1220 |
| M12 | −0.5 | 1230 |
| | −0.3 | 1220 |
| | 0.0 | 1210 |
| | 0.3 | 1310 |
| | 0.5 | 1300 |

As shown in Table 15, it is found that the samples with the distance X as plus, that is, samples wherein the rear end of the glass seal portions is positioned closer to the forward end side than the boundary between the middle barrel portion and increased diameter portion, and the glass seal portions are not disposed on the inner side of the boundary, being such that the breaking load becomes higher, have a superior mechanical strength. It is conceivable that this is because it is possible to more reliably prevent thermal stress generated when sintering the glass seal portions from being applied to the boundary portion between the middle barrel portion and increased diameter portion.

It can be said from the test results that it is preferable to adopt a configuration such that the rear end of the glass seal portions is positioned closer to the forward end of the insulator in the axis direction than the boundary between the middle barrel portion and increased diameter portion in order to further improve the mechanical strength of the boundary portion between the middle barrel portion and increased diameter portion, and thus further enhance durability.

The invention, not being limited to the contents described in the heretofore described embodiment, may be implemented in, for example, the following ways. It goes without saying that other applications and modification examples which are not illustrated below are also possible as a matter of course.

a. In the heretofore described embodiment, the spark plug 1 is such that a spark discharge is generated in the spark discharge gap 29, thereby igniting a fuel gas, but the configuration of a spark plug to which the technical idea of the invention can be applied is not limited to this. Consequently, the technical idea of the invention may be applied to, for example, a spark plug (a plasma jet spark plug), having a cavity portion (a space) in a forward end portion of the insulator, wherein plasma generated in the cavity portion is emitted, thereby igniting a fuel gas.

b. In the heretofore described embodiment, the talc 27 is provided in order to secure a high air tightness in the combustion chamber. As opposed to this, the technical idea of the invention may be applied to a spark plug wherein it is possible to secure a high air tightness in the combustion chamber without providing the talc 27. Consequently, the technical idea of the invention may be applied to, for example, a spark plug of a type (a conical seat type), not including the gasket 22, wherein a forward end surface of the seat portion 20 formed in a tapered shape makes direct contact with an engine head, or a spark plug of a type (a thermal caulking type), not including the ring members 25 and 26 or talc 27, wherein the caulked portion 24 formed by a thermal caulking makes direct contact with the reduced diameter portion 15 of the insulator 2.

c. In the heretofore described embodiment, the case in which the ground electrode 28 is joined to the forward end portion of the metal shell 3 is embodied, but the technical idea of the invention can also be applied to a case in which a ground electrode is formed in such a way as to cut out one portion of a metal shell (or one portion of a forward end metal welded to the metal shell in advance) (for example, JP-A-2006-236906).

d. In the heretofore described embodiment, the tool engagement portion 23 is formed into a hexagonal cross-sectional shape, but the shape of the tool engagement portion 23 is not limited to this kind of shape. The tool engagement portion 23 may be formed in, for example, a Bi-HEX (variant dodecagonal) shape [ISO22977:2005(E)].

What is claimed is:

1. A spark plug, comprising:

an insulator having an axial hole extending in a direction of an axis;

a center electrode inserted in a forward end portion of the axial hole; and a hollow cylindrical metal shell disposed on the outer periphery of the insulator, wherein the insulator includes an insulator nose length portion provided at the forward end of the insulator, and a tapered portion, extending from a rear end of the insulator nose length portion toward a rear end of the insulator in the axis direction, said tapered portion having a diameter increasing toward the rear end of the insulator in the axis direction, and the metal shell includes a shoulder portion, protruding inward in a radial direction, having a retaining surface by which the tapered portion is directly or indirectly retained, and a male thread portion, positioned on the outer peripheral side of the shoulder portion, for bringing the spark plug into threaded engagement with a mounting hole of a combustion device, wherein the thread diameter of the male thread portion is M12 or less, and when the area of a cross section of the insulator, perpendicular to the axis, passing through a boundary between the insulator nose length portion and the tapered portion is B ($mm^2$), and the area of a cross section of the metal shell, perpendicular to the axis, passing through a forward end of the retaining surface is C ($mm^2$), 2.80≤C/B≤3.50 is satisfied.

2. The spark plug according to claim 1, wherein the insulator includes a middle barrel portion, extending from the rear end of the tapered portion toward the rear end of the insulator in the axis direction, larger in diameter than the insulator nose length portion, and an increased diameter portion, extending from the rear end of the middle barrel portion toward the rear end of the insulator in the axis direction, the outside diameter of which is increased toward the rear end of the insulator in the axis direction, wherein when the area of a cross section of the insulator, perpendicular to the axis, passing through a boundary between the middle barrel portion and increased diameter portion is A ($mm^2$), and the mass of the spark plug is M (g), $M/A \leq 1.40$ ($g/mm^2$) is satisfied.

3. The spark plug according to claim 1, wherein the insulator includes;

a middle barrel portion, extending from the rear end of the tapered portion toward the rear end of the insulator in the axis direction, larger in diameter than the insulator nose length portion, an increased diameter portion, extending from the rear end of the middle barrel portion toward the rear end of the insulator in the axis direction, the outside diameter of which is increased toward the rear end of the insulator in the axis direction, a large diameter portion, extending from the rear end of the increased diameter portion toward the rear end of the insulator in the axis direction, larger in diameter than the middle barrel portion, and a reduced diameter portion, extending from the rear end of the large diameter portion toward the rear end of the insulator in the axis direction, the outside diameter of which is reduced toward the rear end of the insulator in the axis direction, wherein when a straight line connecting a boundary point between the visible outline of the large diameter portion and the visible outline of the reduced diameter portion and a boundary point between the visible outline of the middle barrel portion and the visible outline of the increased diameter portion is defined as a straight line L1, a straight line connecting the boundary point between the visible outline of the middle barrel portion and the visible outline of the increased diameter portion and a boundary point between the visible outline of the insulator nose length portion and the visible outline of the tapered portion is defined as a straight line L2, on a section including the axis, and the degree of a smaller angle of the angles formed by the straight line L1 and straight line L2 is G, $G \geq 163°$ is satisfied.

4. The spark plug according to claim 1, wherein when a length of the insulator nose length portion along the axis is K (mm), and the mass of the spark plug is M (g), $(M/B) \cdot K \leq 25.0$ (g/mm) is satisfied.

5. The spark plug according to claim 1, wherein the insulator includes a middle barrel portion, extending from the rear end of the tapered portion toward the rear end of the insulator in the axis direction, larger in diameter than the insulator nose length portion, and an increased diameter portion, extending from the rear end of the middle barrel portion toward the rear end of the insulator in the axis direction, the outside diameter of which is increased toward the rear end of the insulator in the axis direction, and glass seal portions, formed by a glass powder mixture containing glass powder being sintered, which fix the insulator and at least one of the center electrode and a terminal electrode are provided in the axis hole, wherein the rear end of the glass seal portions is positioned closer to the forward end of the insulator in the axis direction than the boundary between the middle barrel portion and increased diameter portion.

* * * * *